US009453489B2

(12) United States Patent
Kees et al.

(10) Patent No.: US 9,453,489 B2
(45) Date of Patent: Sep. 27, 2016

(54) METHOD OF CONTROLLING A FUEL SUPPLY SYSTEM

(71) Applicant: Ford Global Technologies, LLC, Dearborn, MI (US)

(72) Inventors: Donatus Andreas Josephine Kees, Billericay (GB); Stuart Anthony Lane, Stratford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 360 days.

(21) Appl. No.: 14/164,514

(22) Filed: Jan. 27, 2014

(65) Prior Publication Data

US 2014/0224221 A1 Aug. 14, 2014

(30) Foreign Application Priority Data

Feb. 14, 2013 (GB) ..... 1302600.0

(51) Int. Cl.

| | |
|---|---|
| ***F02M 1/00*** | (2006.01) |
| ***F02M 69/46*** | (2006.01) |
| ***F02M 59/02*** | (2006.01) |
| ***F02M 55/02*** | (2006.01) |
| ***F02D 41/38*** | (2006.01) |
| ***F02M 37/00*** | (2006.01) |
| *F02M 55/04* | (2006.01) |

(52) U.S. Cl.

CPC ..... *F02M 69/46* (2013.01); *F02D 41/3845* (2013.01); *F02M 37/0041* (2013.01); *F02M 55/02* (2013.01); *F02M 59/022* (2013.01); *F02D 2200/0602* (2013.01); *F02M 55/04* (2013.01); *F02M 2200/40* (2013.01)

(58) Field of Classification Search

CPC ..... F02M 63/0225; F02M 63/024; F02M 63/0265

USPC ..... 123/445, 447, 457, 510

See application file for complete search history.

(56) References Cited

U.S. PATENT DOCUMENTS 5,701,869 A 12/1997 Richardson et al.
6,951,206 B2 10/2005 Kishimoto (Continued)

FOREIGN PATENT DOCUMENTS

WO 2009152876 A1 12/2009
WO 2012113488 A1 8/2012

OTHER PUBLICATIONS

Lane, Stuart et al., "A Method of Controlling a Fuel Supply System of an Engine of a Motor Vehicle," U.S. Appl. No. 14/103,689, filed Dec. 11, 2013, 52 pages.

*Primary Examiner* — John Kwon

(74) *Attorney, Agent, or Firm* — Julia Voutyras; Alleman Hall McCoy Russell & Tuttle LLP

(57) ABSTRACT

A system and method for controlling a fuel supply system of an engine is disclosed in which an engine driven high pressure fuel pump is operated whenever possible at one of an optimum demand level providing optimum pump efficiency for the current engine speed or at a zero demand level to reduce the fuel used by the engine to drive the high pressure fuel pump. The operating mode used is dependent upon at least one of the amount of fuel currently stored in a high pressure fuel accumulator and whether a current fuel demand Fd exceeds an optimum quantity Po of fuel that can be provided by the high pressure fuel pump when operating at the current engine speed.

20 Claims, 11 Drawing Sheets

(56) References Cited

U.S. PATENT DOCUMENTS

| | | | | |
|---|---|---|---|---|
| 7,717,077 | B2 | 5/2010 | Prior | |
| 2003/0192508 | A1 | 10/2003 | Kishimoto | |
| 2012/0177505 | A1 | 7/2012 | Gerlach | |
| 2014/0163847 | A1* | 6/2014 | Lane | F02D 33/006 701/113 |
| 2014/0229047 | A1* | 8/2014 | Kees | F02D 41/3005 701/22 |

* cited by examiner

PRIOR ART

METHOD OF CONTROLLING A FUEL SUPPLY SYSTEM

CROSS REFERENCE TO RELATED APPLICATIONS

The present application claims priority to Great Britain Patent Application No. 1302600.0, entitled "A Method of Controlling a Fuel Supply System," filed on Feb. 14, 2013, the entire contents of which are hereby incorporated by reference for all purposes.

FIELD

The present description relates to a fuel supply system of an engine and, in particular, to the reduction of losses from a high pressure fuel pump forming part of the fuel supply system.

BACKGROUND AND SUMMARY

It is known to provide a motor vehicle with a fuel supply system having a high pressure fuel pump to supply fuel at high pressure such as 200 MPa to one or more fuel injectors of an engine such as, for example, a diesel engine or gasoline direct injection engine. It is a problem with prior fuel supply systems that the quantity of fuel supplied by the fuel pump when the fuel pump is operating at peak efficiency does not always match the fuel requirements of the engine to which fuel is supplied. In FIG. 7 a fuel quantity versus engine speed chart is shown for a typical high pressure fuel pump in which two exemplary situations of this problem are indicated.

For example, in FIG. 7 the lines x1 to x6 are lines joining points of equal high pressure fuel pump efficiency, the broken line 'Of' is a line joining points of optimum fuel pump efficiency throughout the operating speed range of the engine, Max Eff is an operational point where the high pressure fuel pump is operating at a maximum or peak efficiency and Fd max is a line showing the maximum possible fuel demand for the engine throughout its operating speed range.

In situation "A" the supply of fuel required for the engine is more than the high pressure fuel pump can supply when operating at optimum efficiency for that engine speed. Therefore in such a situation the high pressure fuel pump needs to be operated with an output greater than is optimal for that engine speed in order to meet the fuel demand from the engine. This requires the high pressure fuel pump to be operated at an operating efficiency less than optimal thereby wasting energy driving the high pressure fuel pump.

In situation "B" the high pressure fuel pump is capable of supplying more fuel to the engine than is required to fuel the engine. In such a case either the output from the high pressure fuel pump has to be reduced or excess fuel has to be returned to a low pressure reservoir. In either case energy is wasted either by operating the high pressure fuel pump below its optimum efficiency or by operating at optimum efficiency but producing more fuel than is required.

The inventors have recognized issues with the approaches above and herein provide a method and system for reducing the fuel usage of an engine by operating a high pressure fuel pump more efficiently. According to a first aspect of the present disclosure there is provided a method of controlling an engine fuel supply system comprising an engine driven high pressure fuel pump, a valve means and a high pressure accumulator wherein the method comprises, operating the high pressure fuel pump at one of a zero demand level and an optimum demand level while using the valve to control the flow of fuel to the engine from the high pressure fuel pump and the accumulator to meet a fuel demand from the engine unless the accumulator is empty and the fuel demand from the engine is greater than the amount of fuel available from the high pressure fuel pump when operated at the optimum demand level. In this way, the accumulator may be selectively connectable to the high pressure fuel pump and the engine such that it is connected during some conditions, and not connected during other conditions.

Furthermore, the technical result is achieved that the high pressure fuel pump is operated as efficiently as possible for the maximum time possible.

The method may further comprise determining a current fuel level in the high pressure accumulator, the fuel demand from the engine and a current fuel quantity available from the high pressure fuel pump when operating at the optimum demand level and controlling the flow of fuel to the engine from the high pressure fuel pump and the accumulator to meet the fuel demand from the engine based upon at least one of the amount of fuel stored in the accumulator and a comparison of the current fuel quantity available from the high pressure fuel pump when operating at the optimum demand level with the fuel demand from the engine.

Therefore the flow of fuel to the engine from the high pressure fuel pump and the accumulator may be controlled to meet the fuel demand from the engine based upon at least one of the amount of fuel stored in the accumulator and a comparison of the current optimum fuel quantity available from the high pressure pump with the fuel demand from the engine in order to minimize running of the high pressure fuel pump above a fuel demand level where the optimum fuel quantity is available from the high pressure fuel pump.

If an amount of fuel greater than a predetermined amount is present in the high pressure accumulator then the method may comprise using the fuel from the accumulator and operating the high pressure at a zero demand level. Alternatively, if the amount of fuel in the accumulator is below a predefined threshold and the fuel demand from the engine is less than the current fuel quantity available from the high pressure fuel pump when operating at the optimum demand level, the high pressure fuel pump may be operated at the optimum fuel demand level and any excess fuel is supplied from the high pressure fuel pump to the high pressure accumulator. Still further, if the amount of fuel in the accumulator is below a predefined threshold and the fuel demand from the engine is equal to the current fuel supply output available from the high pressure fuel pump when operating at the optimum demand level, the high pressure fuel pump may be operated at the optimum demand level to supply fuel to the engine. The predefined threshold may be one of a lower predefined threshold and an upper predefined threshold.

If the amount of fuel in the accumulator is empty and the fuel demand from the engine is more than the current fuel quantity available from the high pressure fuel pump when operating at the optimum demand level, the high pressure fuel pump may be operated at a demand level required to meet the fuel demand from the engine. The accumulator may be empty if the amount of fuel in the accumulator is below a predefined lower threshold.

If the amount of fuel in the accumulator is above a predefined upper threshold, the high pressure fuel pump may be operated at a zero demand level and fuel may be supplied to the engine from the high pressure accumulator to meet the fuel demand from the engine. The level of fuel in the high pressure accumulator may be determined by measuring the pressure of the fuel stored in the high pressure accumulator. The predefined lower threshold may be a predefined lower pressure threshold. The predefined upper threshold may be a predefined upper pressure threshold.

If the amount of fuel in the accumulator is between a predefined lower threshold and a predefined upper threshold and the fuel demand from the engine is more than the current fuel quantity available from the high pressure fuel pump when operating at the optimum demand level, the high pressure fuel pump is operated at a zero demand level and fuel is supplied to the engine from the high pressure accumulator to meet the fuel demand from the engine.

If the amount of fuel in the accumulator is between a predefined lower threshold and a predefined upper threshold and the fuel demand from the engine is one of more than and equal to the current fuel quantity available from the high pressure fuel pump when operating at the optimum demand level, the high pressure fuel pump is operated at a zero demand level and fuel is supplied to the engine from the high pressure accumulator to meet the fuel demand from the engine.

According to a second aspect of the present disclosure there is provided an engine fuel supply system comprising a fuel reservoir, a low pressure fuel pump to supply fuel from the reservoir to an engine driven high pressure fuel pump, at least one fuel injector to supply fuel at high pressure to the engine, a fuel accumulator to store fuel at high pressure, a valve means to control the flow of fuel between the high pressure fuel pump, the accumulator and the engine and an electronic controller to control the operation of the high pressure fuel pump, the valve means and the at least one fuel injector, wherein the electronic controller operates the high pressure fuel pump at one of a zero demand level and an optimum demand level and uses the valve to control the flow of fuel to the engine from the high pressure fuel pump and the accumulator to meet a fuel demand from the engine unless the accumulator is empty and the fuel demand from the engine is greater than the amount of fuel available from the high pressure fuel pump when operated at the optimum demand level. This has the advantage that the high pressure fuel pump is operated as efficiently as possible for the maximum time possible.

The electronic controller may be further operable to estimate a current fuel level in the high pressure accumulator, estimate the fuel demand from the engine and estimate a current fuel quantity available from the high pressure fuel pump when operating at the optimum demand level and control the flow of fuel to the engine from the high pressure fuel pump and the accumulator to meet the fuel demand from the engine based upon at least one of the amount of fuel stored in the accumulator and a comparison of the current fuel quantity available from the high pressure pump when operating at the optimum demand level with the fuel demand from the engine.

Therefore the flow of fuel to the engine from the high pressure fuel pump and the accumulator may be controlled by the electronic controller to meet the fuel demand from the engine based upon at least one of the amount of fuel stored in the accumulator and a comparison of the current optimum fuel quantity available from the high pressure pump with the fuel demand from the engine in order to minimize running of the high pressure fuel pump above a fuel demand level where the optimum fuel quantity is available from the high pressure fuel pump.

If the amount of fuel in the accumulator is below a predefined threshold and the fuel demand from the engine is less than the current fuel quantity available from the high pressure fuel pump when operating at the optimum demand level, the electronic controller operates the high pressure fuel pump at the optimum fuel demand level and controls the valve means so that any excess fuel is supplied from the high pressure fuel pump to the high pressure accumulator.

If the amount of fuel in the accumulator is below a predefined threshold and the fuel demand from the engine is equal to the current fuel quantity available from the high pressure fuel pump when operated at the optimum fuel demand level, the electronic controller may operate the high pressure fuel pump at the current optimum fuel demand level and may control the valve means to supply fuel to the engine. The predefined threshold may be one of a lower predefined threshold and an upper predefined threshold.

If the amount of fuel in the accumulator is empty and the fuel demand from the engine is more than that available if the high pressure fuel pump is operated at the optimum fuel demand level, the electronic controller may operate the high pressure fuel pump at a demand level required to meet the fuel demand from the engine and may operate the valve means to supply fuel from the high pressure fuel pump to the engine, to isolate the high pressure accumulator from the high pressure fuel pump and isolate the high pressure accumulator from the engine. The accumulator may be empty if the amount of fuel in the accumulator is below a predefined lower threshold.

If the amount of fuel in the accumulator is above a predefined threshold, the electronic controller operates the high pressure fuel pump at a zero demand level and operates the valve means to permit fuel to be supplied to the engine from the high pressure accumulator to meet the fuel demand from the engine.

If the amount of fuel in the accumulator is between a predefined lower threshold and a predefined upper threshold and the fuel demand from the engine is more than the current fuel quantity available from the high pressure fuel pump when operating at the optimum demand level, the electronic controller operates the high pressure fuel pump at a zero demand level and operates the valve means to supply fuel from the high pressure accumulator to the engine to meet the fuel demand from the engine.

If the amount of fuel in the accumulator is between a predefined lower threshold and a predefined upper threshold and the fuel demand from the engine is one of more than and equal to the current fuel quantity available from the high pressure fuel pump when operating at the optimum demand level, the electronic controller operates the high pressure fuel pump at a zero demand level and operates the valve so that fuel is supplied to the engine from the high pressure accumulator to meet the fuel demand from the engine.

According to a third aspect of the present disclosure there is provided a motor vehicle having an engine and a fuel supply system wherein the fuel supply system is a fuel supply system constructed in accordance with said second aspect of the present disclosure.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description.

Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
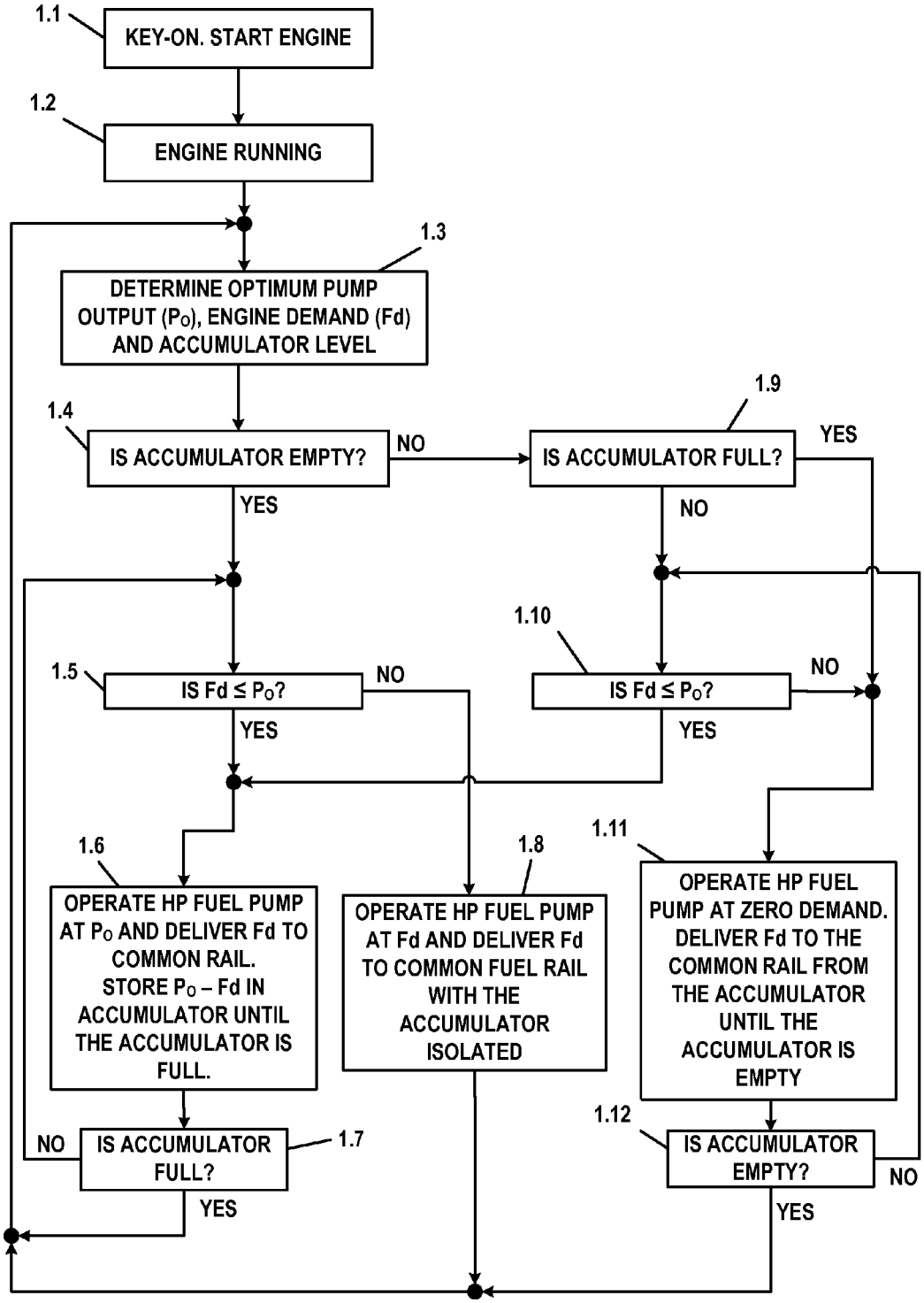
FIG. 1 is a high level flowchart showing a method of controlling a fuel system of an engine of a motor vehicle in accordance with a first aspect of the present disclosure.
Figure 2:
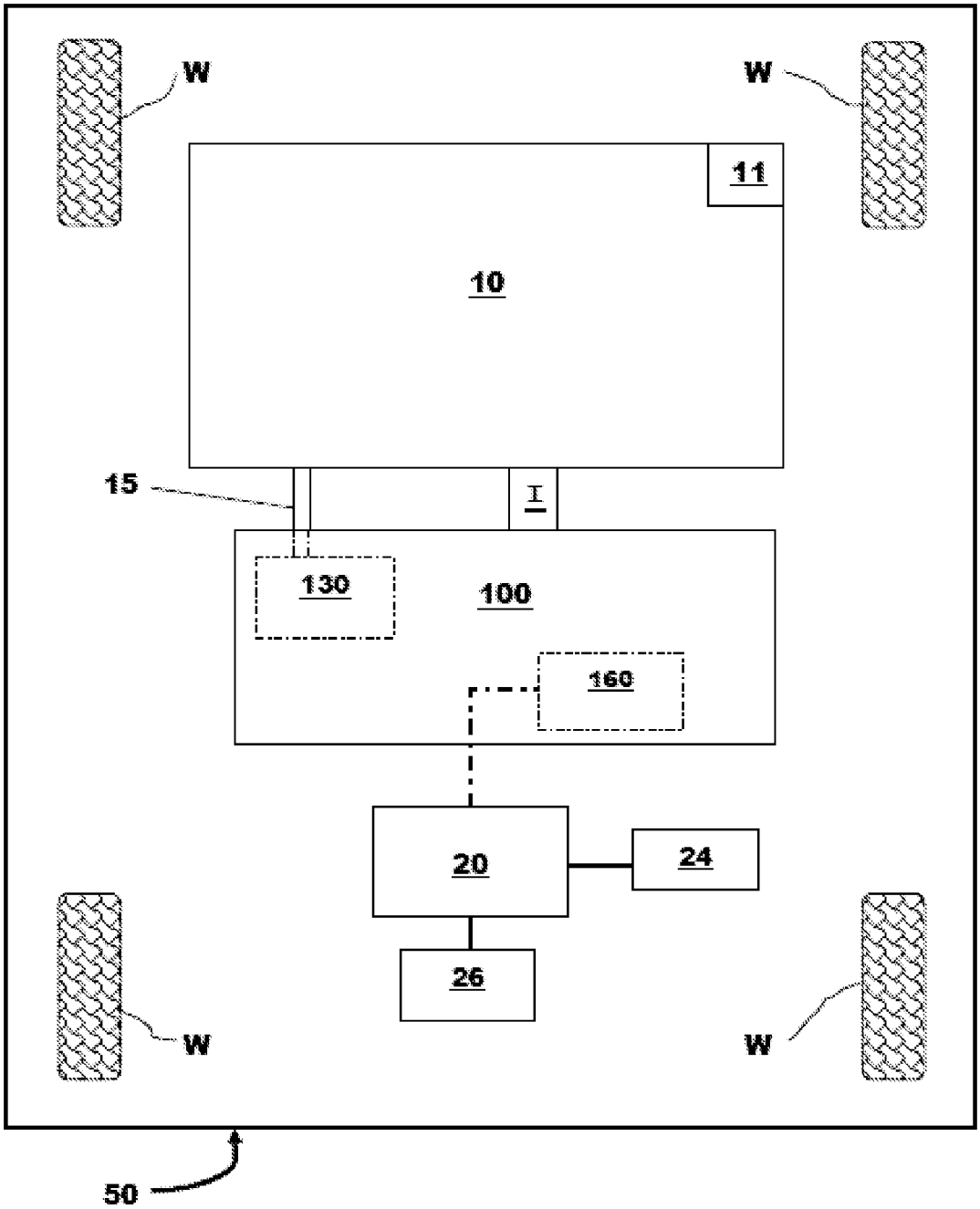
FIG. 2 is a schematic plan view of a motor vehicle according to a third aspect of the present disclosure having a fuel supply system according to a second aspect of the present disclosure.

With reference to FIG. 1 there is shown a high level flow chart of a method of controlling a fuel supply system of an engine of a motor vehicle according to the present disclosure such as the engine shown in FIG. 2 and the fuel supply system shown in FIGS. 3 to 6.

The method starts at box 1.1 which includes a manual key-on event and an engine start event. The method then advances to box 1.2 where the engine is running and onto box 1.3 where an optimized output (Po) from an engine driven high pressure fuel pump is determined based upon current engine speed, a current engine fuel demand (Fd) is determined and the amount of fuel in a high pressure fuel accumulator is determined. The optimized output (Po) is referred to as an optimum demand level for the high pressure fuel pump and is the demand level where the high pressure fuel pump is operating at the peak efficiency for any given engine speed.

In the case of the optimized output Po from the high pressure fuel pump this can be determined or estimated in various ways including, but not limited to, using an algorithm referencing engine speed against fuel supply quantity for optimum fuel pump efficiency or via a look-up table referencing engine speed versus fuel supply quantity for optimum fuel pump efficiency. Whatever method is used, a figure for an optimized or optimal fuel supply quantity (Po) from the high pressure fuel pump when operating at peak efficiency at the current engine speed is produced. This is the optimum fuel demand level for the high pressure fuel pump at the current engine speed.

In the case of the fuel demand (Fd) for the engine this can be determined in a number of ways as is well known in the art. That is to say, it is well known to control one or more fuel injectors to provide a specific mass of fuel per millisecond in order to meet a torque demand for an engine in an economical and low emission manner. In all cases a quantity of fuel required to operate the engine to meet a current torque demand is produced and this constitutes the fuel demand Fd of the engine.

In the case of the high pressure accumulator, the amount of the fuel in the high pressure accumulator can be determined or estimated based upon the pressure of the fuel in the high pressure accumulator. This is because the high pressure accumulator includes a spring that is compressed when the high pressure accumulator is filled with fuel and so when the high pressure accumulator is empty the pressure in the high pressure accumulator will be less than when the high pressure accumulator is full because the spring is less compressed when the high pressure accumulator is empty. It will be appreciated that the term high pressure accumulator means an accumulator capable of storing fuel at a high pressure such as 100 to 200 MPa (1000 to 2000 Bar).

Then in box 1.4 it is checked to see whether the high pressure accumulator is empty. In practice this may be a check to see whether the amount of fuel stored in the high pressure accumulator is below a predefined lower threshold. That is to say, if the pressure of the fuel in the high pressure accumulator is below a lower predefined pressure then the high pressure accumulator will be assumed to be 'empty'. The lower predefined pressure is chosen to be such that a small amount of fuel may still be present in the high pressure accumulator such as 5% of total capacity. The use of this lower threshold allows for calibration errors and for changes in fuel volume due to temperature changes. The amount of fuel remaining at the predefined lower threshold is such that it could not be used to fuel the engine for more than a very short period of time.

Assuming that the amount of fuel in the high pressure accumulator is below the predefined lower threshold (the high pressure accumulator is 'empty') the method advances to box 1.5.

In box 1.5 a comparison is made between the fuel demand Fd of the engine and the optimized fuel supply quantity Po available from the high pressure fuel pump. In the example shown the logic is based upon the test "Is Fd<Po?" but it will be appreciated that by reversing the 'Yes' and 'No' outputs from box 1.5 and replacing the test with the test "Is Fd>Po?" a similar result will be achieved. That is to say, if the high pressure fuel pump can be operated efficiently (at Po) to supply the demanded fuel Fd it is so used.

Returning now to box 1.5, if the fuel demand Fd from the engine is less than or equal to the optimized fuel supply quantity Po then the method advances to box 1.6.

In box 1.6 the high pressure fuel pump is operated at its optimized fuel supply quantity (Po) and any excess fuel (Po-Fd) is supplied to the high pressure accumulator so as to fill the high pressure accumulator. In box 1.7 it is checked whether the high pressure accumulator is full. In practice this is a check to determine whether the pressure in the high pressure accumulator is greater than a predefined upper threshold. If the pressure is lower than the predefined upper threshold then the method returns to box 1.5 and will cycle around boxes 1.5, 1.6 and 1.7 until either the fuel demand Fd from the engine is no longer less than or equal to the optimized fuel supply quantity Po available from the high pressure fuel pump or the pressure in the high pressure accumulator is greater than the predefined upper threshold.

In the case where the pressure in the high pressure accumulator exceeds the predefined upper threshold when checked in box 1.7 the method returns to box 1.3.

In the case where the fuel demand Fd from the engine is no longer less than or equal to the optimized fuel supply quantity Po available from the high pressure fuel pump, that is to say Fd>Po the method advances from box 1.5 to box 1.8.

In box 1.8 all of the fuel for the engine has to be supplied by the high pressure fuel pump even if this means operating with the high pressure fuel pump in a less efficient manner. That is to say, the fuel pump has to be operated as it would normally be with a conventional fuel supply system to meet a current fuel demand (Fd) from the engine. From box 1.8 the method returns to box 1.3 and the steps 1.3 to 1.5 are executed again.

Returning to box 1.4, if there is fuel in the accumulator, that is to say the pressure in the high pressure accumulator is above the predefined lower threshold then the method advances to box 1.9.

In box 1.9 it is checked whether the high pressure accumulator is full. In practice this is a check to determine whether a predefined large amount of fuel is in the high pressure accumulator. As before this is determined based upon a measurement of the pressure of the fuel in the high pressure accumulator and so if the pressure in the high pressure accumulator is greater than a predefined upper pressure threshold the high pressure accumulator is said to be full. This upper threshold may equate for example to a high pressure accumulator in which the quantity of fuel is more than 95% of the total fuel capacity of the high pressure accumulator.

If the high pressure accumulator is determined to be "full" then the method advances to box 1.11 where fuel is supplied from the high pressure accumulator to the engine and the high pressure fuel pump is operated at a zero demand level.

The method advances from box 1.11 to box 1.12 where it is checked to see if the amount of fuel in the high pressure accumulator has dropped below the predefined lower threshold and, if it has, the method returns to box 1.3 but otherwise it goes to box 1.10 described hereinafter.

Referring back to box 1.9, if the amount of fuel in the high pressure accumulator is determined to be less than the predefined upper threshold then the method advances to box 1.10.

In box 1.10 a comparison is made between the fuel demand Fd of the engine and the optimized fuel supply quantity Po available from the high pressure fuel pump. In the example shown the logic is based upon the test "Is Fd<Po?" but it will be appreciated that by reversing the 'Yes' and 'No' outputs from box 1.10 and replacing the test with the test "Is Fd>Po?" a similar result will be achieved.

As an alternative to the use of a test where if Fd is equal or less than Po meaning that 1.11 is only reached from 1.10 if Fd is more than Po, it will be appreciated that by replacing the test in 1.10 with the test (Is Fd<Po?) then if Fd is more than or equal to Po the method would advance from box 1.10 to 1.11.

Returning now to box 1.10, if the fuel demand Fd from the engine is less than or equal to the optimized fuel supply quantity Po available from the high pressure fuel pump, the method advances from box 1.10 to box 1.6.

In box 1.6 the high pressure fuel pump is operated as previously described at its optimized fuel supply quantity (Po) and any excess fuel (Po-Fd) is supplied to the high pressure accumulator so as to fill the high pressure accumulator. In box 1.7 it is checked whether the high pressure accumulator is full which is, as before described, a check to determine whether the pressure in the high pressure accumulator is greater than the predefined upper threshold.

Following box 1.6 if, when checked in box 1.7, the pressure in the high pressure accumulator is lower than the predefined upper threshold then the method returns to box 1.5 and will cycle around boxes 1.5, 1.6 and 1.7 until either the fuel demand Fd from the engine is no longer less than or equal to the optimized fuel supply quantity Po available from the high pressure fuel pump or the pressure in the high pressure accumulator is greater than the predefined upper threshold.

If, when checked in box 1.7, the pressure in the high pressure accumulator exceeds the predefined upper threshold the method returns from box 1.7 to box 1.3 and will then advance to box 1.9 because the pressure in the high pressure accumulator is now above the predefined lower threshold.

In box 1.10, if the fuel demand Fd from the engine is not less than or equal to the optimized fuel supply quantity Po available from the high pressure fuel pump, that is to say, Fd>Po, the method advances from box 1.10 to box 1.11 where all of the fuel for the engine is supplied by the high pressure accumulator and the high pressure fuel pump is operated at a zero demand level. That is to say, if there is a sufficient quantity of fuel in the high pressure accumulator to supply the engine with fuel and the fuel demand Fd from the engine is greater than the optimized fuel supply quantity Po available from the high pressure fuel pump, fuel is supplied from the high pressure accumulator and not the high pressure fuel pump thereby reducing the energy wasted driving the fuel pump inefficiently.

Therefore a method is provided that enables a fuel pump to be operated independently of engine fuel demand in most circumstances, the exception being when there is no fuel in the high pressure fuel accumulator and the fuel demand of the engine Fd is greater than the fuel supply quantity Po that can be supplied by the high pressure fuel pump when operated at the optimum demand level. The fuel pump can therefore be operated at its optimum demand level to produce an optimized fuel supply quantity Po or be set to a zero output level. Therefore less energy is wasted driving the fuel pump than would otherwise be the case and, because the fuel pump is driven by the engine, this results in a reduction in the fuel used by the engine.

In a case where the fuel demand Fd from the engine is less than the optimized fuel supply quantity Po available from the high pressure fuel pump for the current engine speed, fuel is usefully stored in the high pressure accumulator rather than being wastefully returned or vented back to a fuel reservoir.

With particular reference to FIG. 2 there is shown a motor vehicle 50 having four road wheels 'W', a diesel engine 10, a fuel supply system 100 for the engine 10 and a system controller 20 (e.g., a stop-start system). Although the present disclosure is described with reference to a diesel engine it will be appreciated that it could be applied to other engine types that utilize a high pressure fuel injection system such as, for example and without limitation, a direct injection gasoline engine.

The engine 10 is driveably connected in this case to two of the road wheels by a transmission (not shown) but it will be appreciated that the transmission could in other embodiments driveably connect the engine 10 to all four of the road wheels 'W'. It will also be appreciated that the present disclosure is not limited to use with a four wheeled road vehicle and could be applied to a vehicle having two wheels or more than four wheels.

A starter motor 11 is provided to start the engine 10. It will however be appreciated that any suitable cranking means could be used.

A central electronic system controller 20 is shown connected to the fuel supply system 100, the system controller 20 receives vehicle information from vehicle inputs (shown diagrammatically as a single box 24) that are used by the fuel supply system 100 to control the fuelling of the engine 10 via one or more fuel injectors 'I'. Such inputs 24 are well known in the art and may include, for example and without limitation, engine speed, driver demand, mass air flow, air temperature, coolant temperature, ambient temperature and ambient atmospheric pressure.

The system controller 20 also receives operator information from a number of driver inputs (shown diagrammatically as a single box 26) that are used to control operation of the motor vehicle 50. These may include clutch pedal position, brake pedal position, steering wheel position but for the purpose of the present disclosure must include some indication of driver torque request from the engine 10. This torque request can be via a measurement/sensing of accelerator pedal position or, in the case of a gasoline engine, a measurement/sensing of throttle valve position.

The system controller 20 is connected to an electronic controller 160 forming part of the fuel supply system 100 and supplies data/information to the electronic controller 160 from the vehicle and driver inputs 24, 26. It will however be appreciated that the electronic controller 160 could be directly connected to the vehicle and driver inputs 24, 26.

The fuel supply system 100 also includes an engine driven variable output high pressure fuel pump 130 that is driven, as is well known in the art, by a mechanical drive 15 from one end of a camshaft (not shown) of the engine 10. It will however be appreciated by those skilled in the art that other mechanical drive means could be used and that the present disclosure is not limited to the use of a camshaft driven high pressure fuel pump 130.

A high pressure fuel pump such as the high pressure fuel pump 130 requires a high driving torque in order to produce the high fuel pressure required for injection such as for example 100 to 200 MPa. Although it would theoretically be possible to drive such a high pressure fuel pump using an electric motor this is less efficient than driving the pump directly from the engine due to the need to produce a high driving torque for the high pressure fuel pump and the inefficiencies associated with converting electrical energy into torque for driving the high pressure fuel pump. It will be appreciated that any electrical energy used by such an electric motor has to be replaced by some means and this too leads to inefficiencies in energy conversion. It is therefore advantageous to use a high pressure fuel pump driven by the engine for which it supplies fuel.

Variable output high pressure fuel pumps are known from, for example and without limitation, US Patent Application 20120177505 and PCT patent publication WO-2012113488. The fuel supply system 100 is described in greater detail with reference to four embodiments shown in FIGS. 3 to 6 respectively hereinafter.

Although the electronic controller 160 of the fuel supply system 100 and the system controller 20 are shown in FIG. 2 as separate units it will be appreciated that they could be embodied as a single electronic controller such as a powertrain controller.

Figure 3:
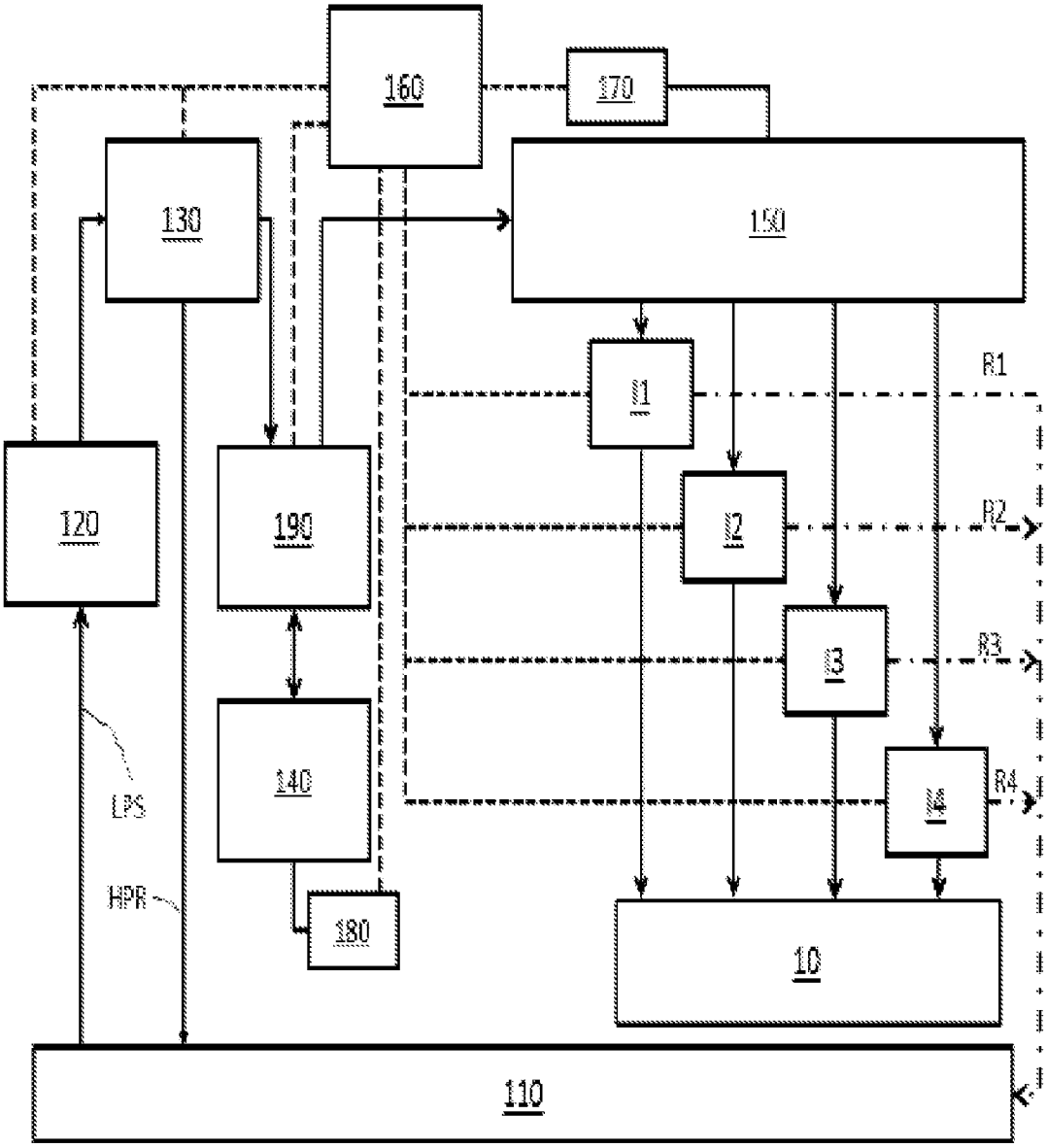
FIG. 3 is a block diagram representation of a first embodiment of the fuel supply system shown in FIG. 2.

Referring now to FIG. 3 there is shown in greater detail a first embodiment of the fuel supply system shown in FIG. 2.

The fuel supply system 100 comprises a fuel reservoir or fuel tank 110 used to store fuel for use by the engine 10. Fuel is drawn from the fuel tank 110 by a low pressure fuel pump 120 and is supplied to an inlet of the variable output high pressure fuel pump 130 via a low pressure fuel supply line LPS. The high pressure fuel pump 130 is controlled by the electronic controller 160 between a minimum demand level and a maximum demand level. The minimum demand level will preferably result in a fuel flow rate from the high pressure fuel pump 130 of substantially zero and is called the zero demand level and the maximum demand level will result in the maximum possible flow from the high pressure fuel pump 130 for the current engine speed. When operating at the minimum demand level, the high pressure fuel pump 130 requires a minimal driving force to be provided from the engine 10 and, when operating at the maximum demand level, the high pressure fuel pump 130 requires a high driving force to be supplied from the engine 10. Excess or leaked fuel from the high pressure fuel pump 130 is returned to the fuel tank 110 via a low pressure return line HPR.

A valve means in the form of a single electronically controlled diverter valve 190 is connected to an output from the high pressure fuel pump 130 so as to receive a flow of fuel at high pressure therefrom.

Figure 10A:
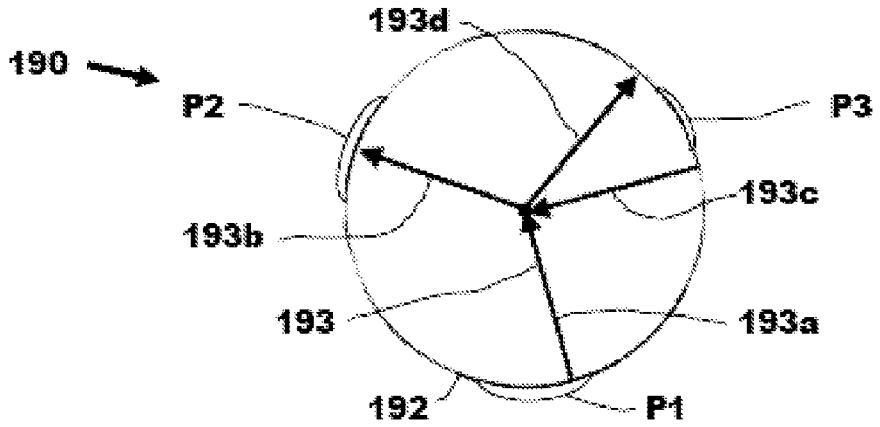
FIGS. 10A to 10C are diagrammatic representations of a high pressure fuel flow diverter valve showing the valve in three different flow path states.
Figure 10B:
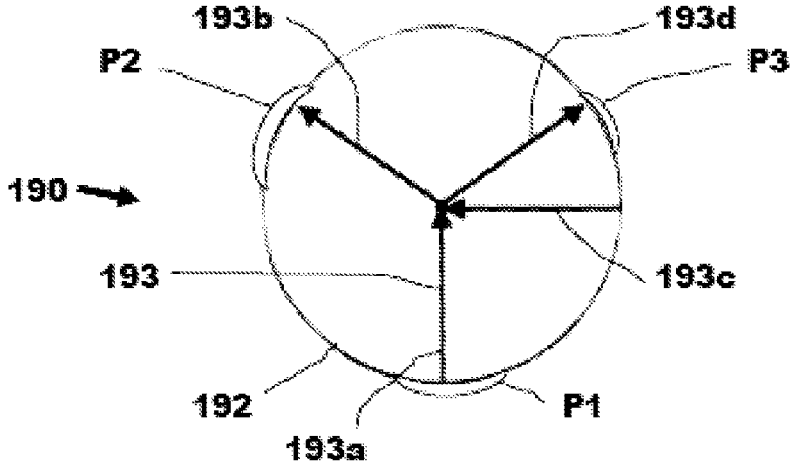
Figure 10C:
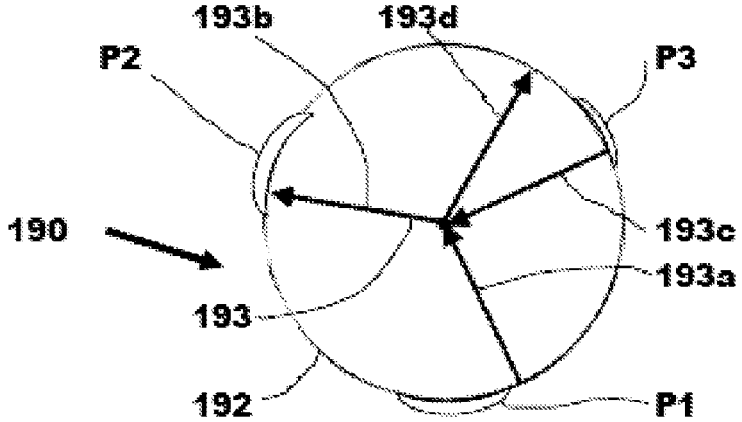

The diverter valve 190 is best understood with reference to FIGS. 10*a* to 10*c* which are schematic representations of one embodiment of the valve 190. The valve 190 has a body (not shown) in which is rotatably mounted a valve member 192 defining a fuel flow passage 193 comprised of four limbs 193*a*, 193*b*, 193*c* and 193*d*. Each of the limbs 193*a*, 193*b*, 193*c* and 193*d* or an associated fluid conduit is provided with a one way flow valve so that fuel can only flow in the direction of the arrows heads indicated on FIGS. 10*a* to 10*c*.

The body defines a first port P1 that is connected by a respective fluid conduit to the high pressure fuel pump 130, a second port P2 that is connected by a respective fluid conduit to the common fuel rail 150 and a third port P3 that is connected by a respective fluid conduit to the high pressure fuel high pressure accumulator 140.

The diverter valve 190 is interposed between the high pressure fuel pump 130 and the common fuel rail 150, between the high pressure fuel pump 130 and the high pressure accumulator 140 and between the high pressure accumulator 140 and the common fuel rail 150 so as to control the flow of fuel therebetween as will now be described.

In FIG. 10*a* the valve member 192 is shown in a position in which the fuel flow passage 193 defines a fuel flow path connecting the high pressure fuel pump 130 to the common fuel rail 150. The limb 193*a* is aligned with the first port P1, the limb 193*b* is aligned with the second port P2 and the third and fourth limbs 193*c*, 193*d* are not aligned with any of the ports P1, P2 or P3. Therefore when the valve member 192 is in this rotational position, the high pressure accumulator 140 is isolated from both the high pressure fuel pump 130 and the common fuel rail 150.

In FIG. 10*b* the valve member 192 is shown in a position in which the fuel flow passage 193 defines via the first and second limbs 193*a*, 193*b* a fuel flow path connecting the high pressure fuel pump 130 to the common fuel rail 150 and via the first and fourth limbs 193*a*, 193*d* a fuel flow path connecting the high pressure fuel pump 130 to the high pressure accumulator 140. In this position the first limb 193*a* communicates with the first port P1, the second limb 193*b* communicates with the second port P2 and the fourth limb 193*d* communicates with the third port P3. Fuel can therefore flow from the high pressure fuel pump 130 to both the common fuel rail 150 and to the high pressure accumulator 140.

In FIG. 10*c* the valve member 192 is shown in a position in which the fuel flow passage 193 defines via the third and second limbs 193*c*, 193*b* a fuel flow path connecting the high pressure accumulator 140 to the common fuel rail 150. In this position the second limb 193*b* communicates with the second port P2 and the third limb 193*c* communicates with the third port P3. Fuel can therefore flow from the high pressure accumulator 140 to the common fuel rail 150.

The valve member 192 is rotatable by an electric actuator (not shown) in response to a control input from the electronic controller 160 so that the selection of flow path is controlled by the electronic controller 160.

It will be appreciated that alternative forms of diverter valve could be constructed and that the present disclosure is not limited to the rotary diverter valve 190 shown in FIGS. 10*a* to 10*c*.

Referring back now to FIG. 3, the common fuel rail 150 is arranged to supply fuel to four fuel injectors I1, I2, I3 and I4, the operation of each of which is controlled by the electronic controller 160.

Each of the fuel injectors I1, I2, I3 and I4 supply fuel to the engine 10 at the timing and volume required based upon a respective control input received from the electronic controller 160. Excess fuel from the fuel injectors I1, I2, I3 and I4 is returned to the fuel tank 110 via respective low pressure return lines R1, R2, R3 and R4.

It will be appreciated that the present disclosure is not limited to use with four fuel injectors and that a fuel supply system having less or more fuel injectors could beneficially utilize the present disclosure.

Figure 11A:
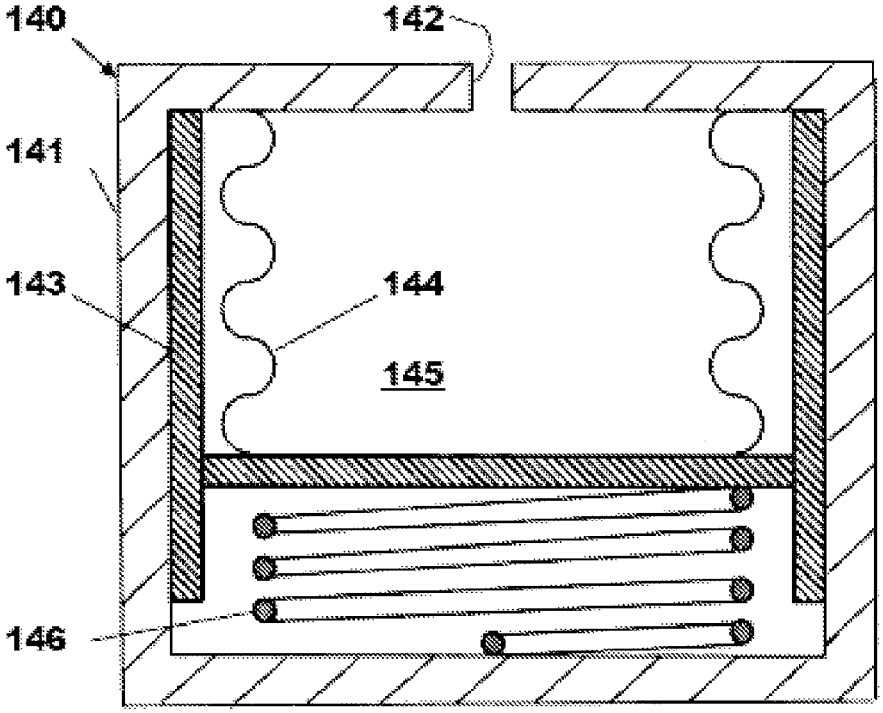
FIGS. 11A and 11B are diagrammatic representations of a high pressure fuel accumulator suitable for use in a fuel supply system constructed in accordance with said second aspect of the present disclosure.
Figure 11B:
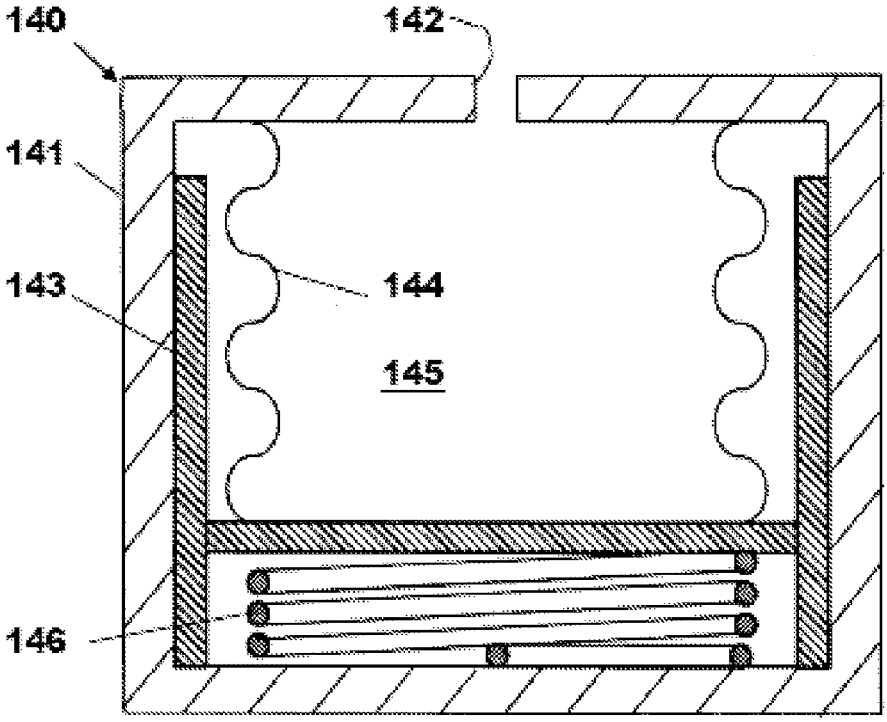

A fuel pressure sensor 170 is arranged to sense the pressure of fuel in the common fuel rail 150 and supply a signal indicative of the sensed pressure to the electronic controller 160. The high pressure accumulator 140 can be of any suitable construction. U.S. Pat. No. 7,717,077 discloses a free piston acted on by a spring for use as a fuel high pressure accumulator. Such an arrangement would be suitable for use but it is preferred if a sealed bellows type of accumulator such as that shown in FIGS. 11*a* and 11*b* is used because with such an accumulator no fuel can leak from the accumulator whereas with the free piston accumulator shown in U.S. Pat. No. 7,717,077 there is the potential for fuel to leak past the piston. This is a particular problem in the case of a high pressure fuel accumulator of the type used for the present disclosure because the pressure to be contained is in the order of 100 to 200 MPa depending upon the particular injection pressure required and whether the viscosity of fuel is relatively low. It will be appreciated that the high pressure fuel accumulator 140 has to be capable of storing fuel at the pressure required for injection into the engine 10.

The high pressure accumulator 140 is shown in FIG. 11*a* in an empty state and in FIG. 11*b* in a full state. The high pressure accumulator comprises a body 141 defining a flow passage 142 by which fuel can enter or leave a storage volume 145 defined by a cup shaped piston, a metal bellows 144 and the body 141. The piston 143 supports the bellows 144 and is slidingly supported by the body 141. A spring 146 biases the piston 143 towards the end of the body 141 at which fuel enters or leaves the storage volume 145 via the flow passage 142. The bellows 144 is configured to be sealed to both the body 141 and the piston 143 and so there is no possibility of leakage of fuel. It will be appreciated that in practice the body 141 will not be a single component but will be constructed to enable assembly of the various components 143, 144, 146.

A fuel pressure sensor 180 is arranged to sense the pressure of fuel in the high pressure accumulator 140 and supply a signal indicative of the sensed pressure to the electronic controller 160. The magnitude of this pressure signal is used to determine or estimate the amount of fuel stored in the high pressure accumulator 140. It will be appreciated that the pressure in the high pressure accumulator 140 is greater when the high pressure accumulator is full of fuel than when it is empty and that there is a relationship between the amount of fuel stored in the high pressure accumulator 140 and the pressure of the fuel in the high pressure accumulator 140 related to the compression rate of the spring 146.

Figure 4:
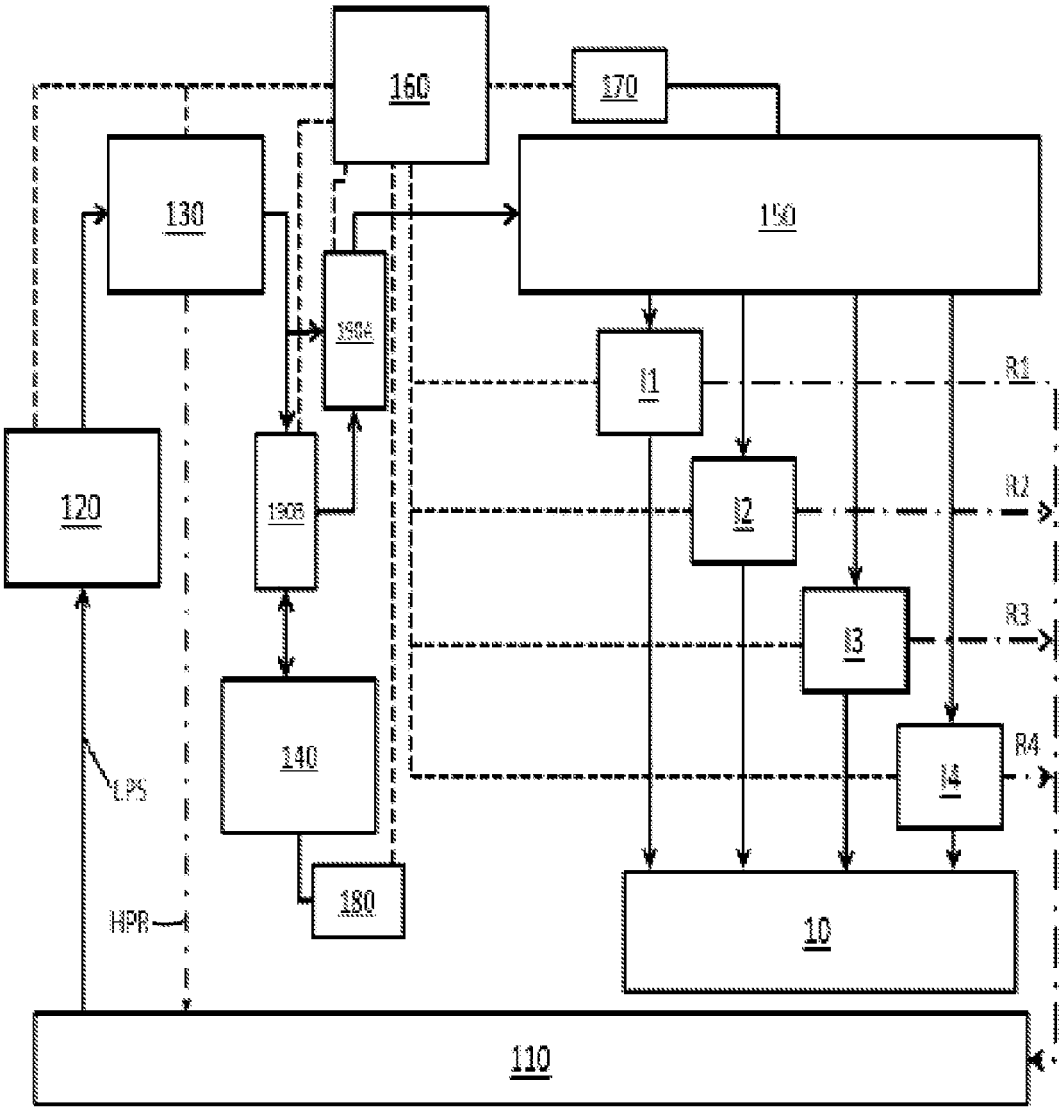
FIG. 4 is a block diagram representation of a second embodiment of the fuel supply system shown in FIG. 2.
Figure 5:
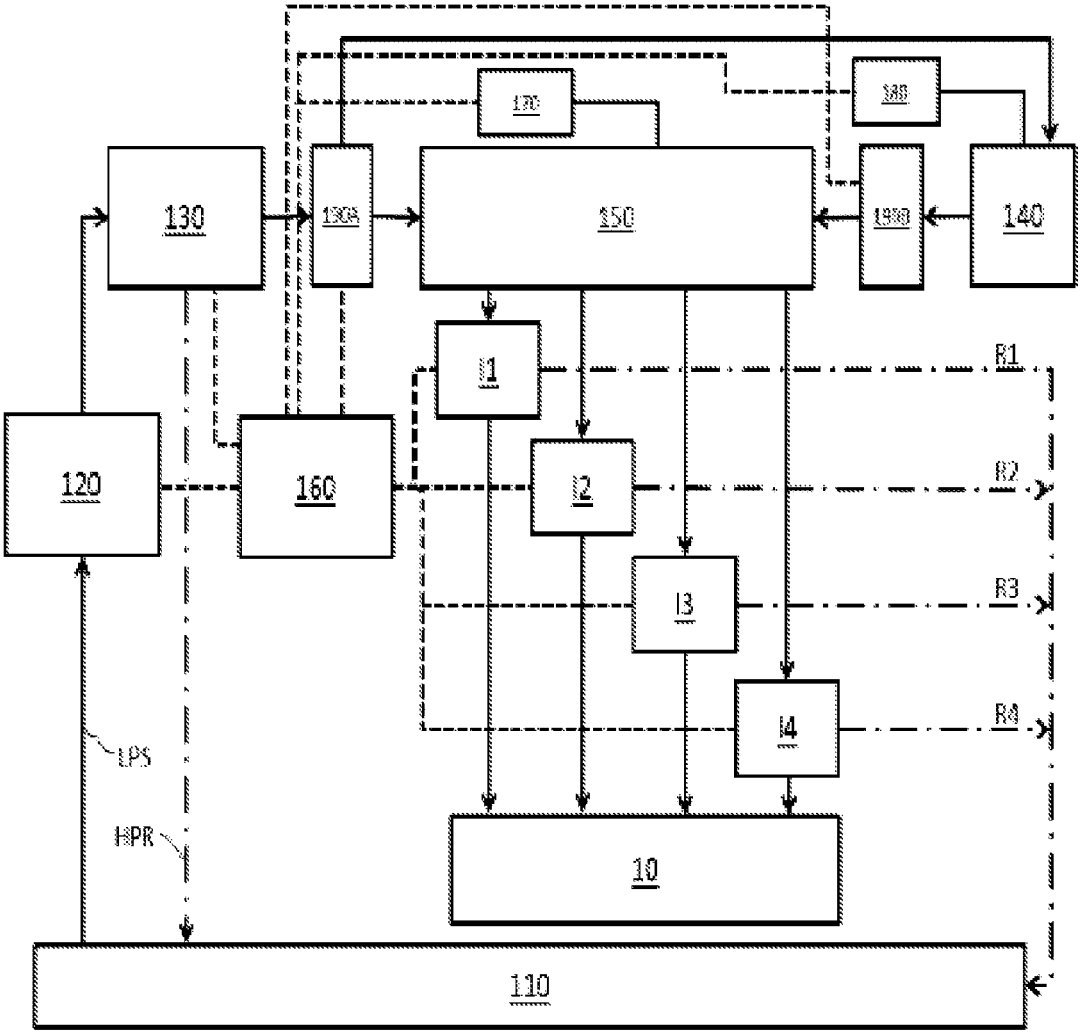
FIG. 5 is a block diagram representation of a third embodiment of the fuel supply system shown in FIG. 2.
Figure 6:
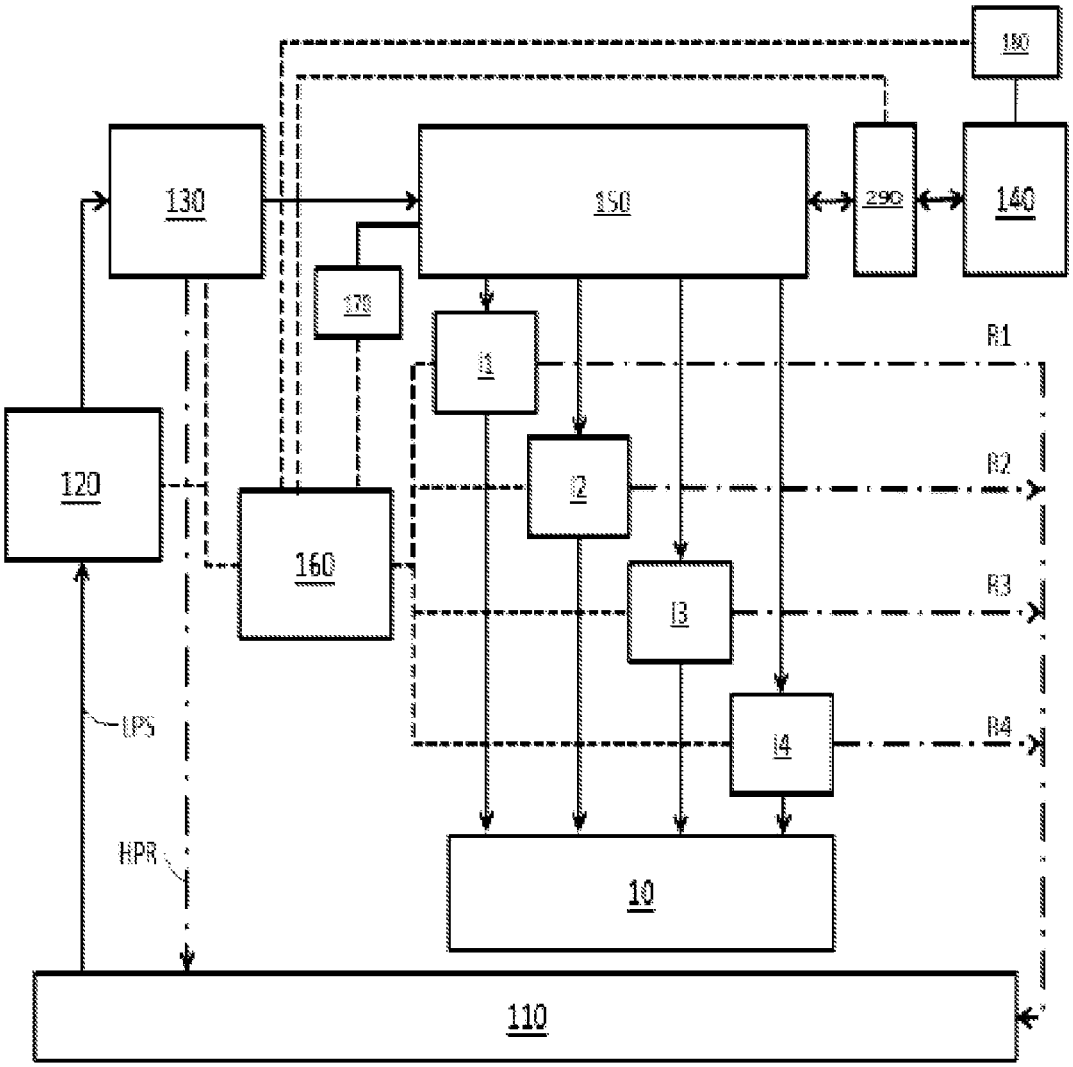
FIG. 6 is a block diagram representation of a fourth embodiment of the fuel supply system shown in FIG. 2.
Figure 7:
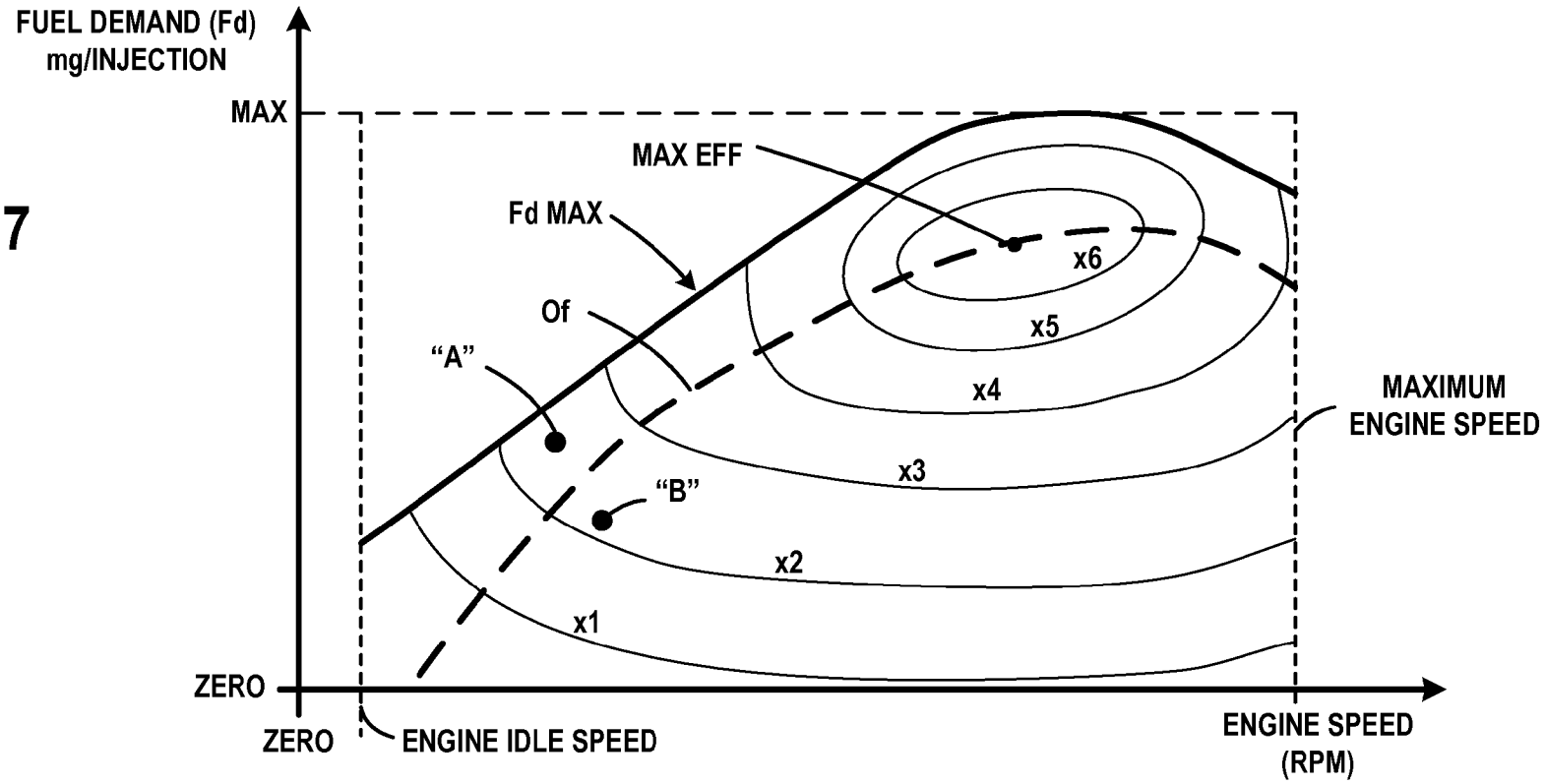
FIG. 7 is a fuel demand versus engine speed chart showing two prior art situations in which a fuel demand from an engine is not matched to optimum fuel pump efficiency.

FIGS. 4 to 6 show, respectively, second, third and fourth embodiments of a fuel supply system according to the present disclosure.

All of these embodiments are in most respects similar to the first embodiment shown in FIG. 3 and comprise of similar components with the exception of the type and arrangement of the valve means.

In the second embodiment shown in FIG. 4 the valve means comprises first and second valves 190A and 190B. The first valve 190A is a two way valve that either permits fuel to flow from the high pressure fuel pump 130 to the common fuel rail 150 or from the second valve 190B to the common fuel rail 150. The second valve 190B is a two way valve that either permits fuel to flow from the high pressure fuel pump 130 to the high pressure accumulator 140 or from the high pressure accumulator 140 to the first valve 190A. Note that fuel cannot flow from the first valve 190A to the second valve 190B as indicated by the arrow head pointing towards the first valve 190A. The arrow heads on FIG. 4 indicate the direction of flow through the first and second valves 190A and 190B and indicate that in most cases a one way valve is included to prevent reverse flow.

In the third embodiment shown in FIG. 5 the valve means comprises first and second valves 190A and 190B. The first valve 190A is operable to isolate the high pressure fuel pump 130 from the common fuel rail and the high pressure accumulator 140, permit fuel to flow from the high pressure fuel pump 130 to the common fuel rail 150 or permit fuel to flow from the high pressure fuel pump 130 to the common fuel rail and to the high pressure accumulator 140. The second valve 190B is a flow control valve that is operable in response to commands from the electronic controller 160 to control the flow of fuel from the high pressure accumulator 140 to the common fuel rail 150. The arrow heads on FIG. 5 indicate the direction of flow through the first and second valves 190A and 190B and indicate that in all cases a one way valve is included to prevent reverse flow.

In the fourth embodiment shown in FIG. 6 the valve means comprises a single valve 290. The valve 290 is a flow control valve that is operable in response to commands from the electronic controller 160 to control the flow of fuel from the high pressure accumulator 140 to the common fuel rail 150 and is also operable to control the flow of fuel from the common fuel rail 150 to the high pressure accumulator 140. In this embodiment the high pressure accumulator 140 is filled via the common fuel rail 150. The arrow heads on FIG. 6 indicate that the direction of flow through the valve 290 can be in either direction and that no one way valves are used between the valve 290 and either the common fuel rail 150 or the high pressure accumulator 140. Operation of the fuel supply system 100 shown in FIG. 3 will now be described with reference to FIGS. 8 and 9.

Figure 8:
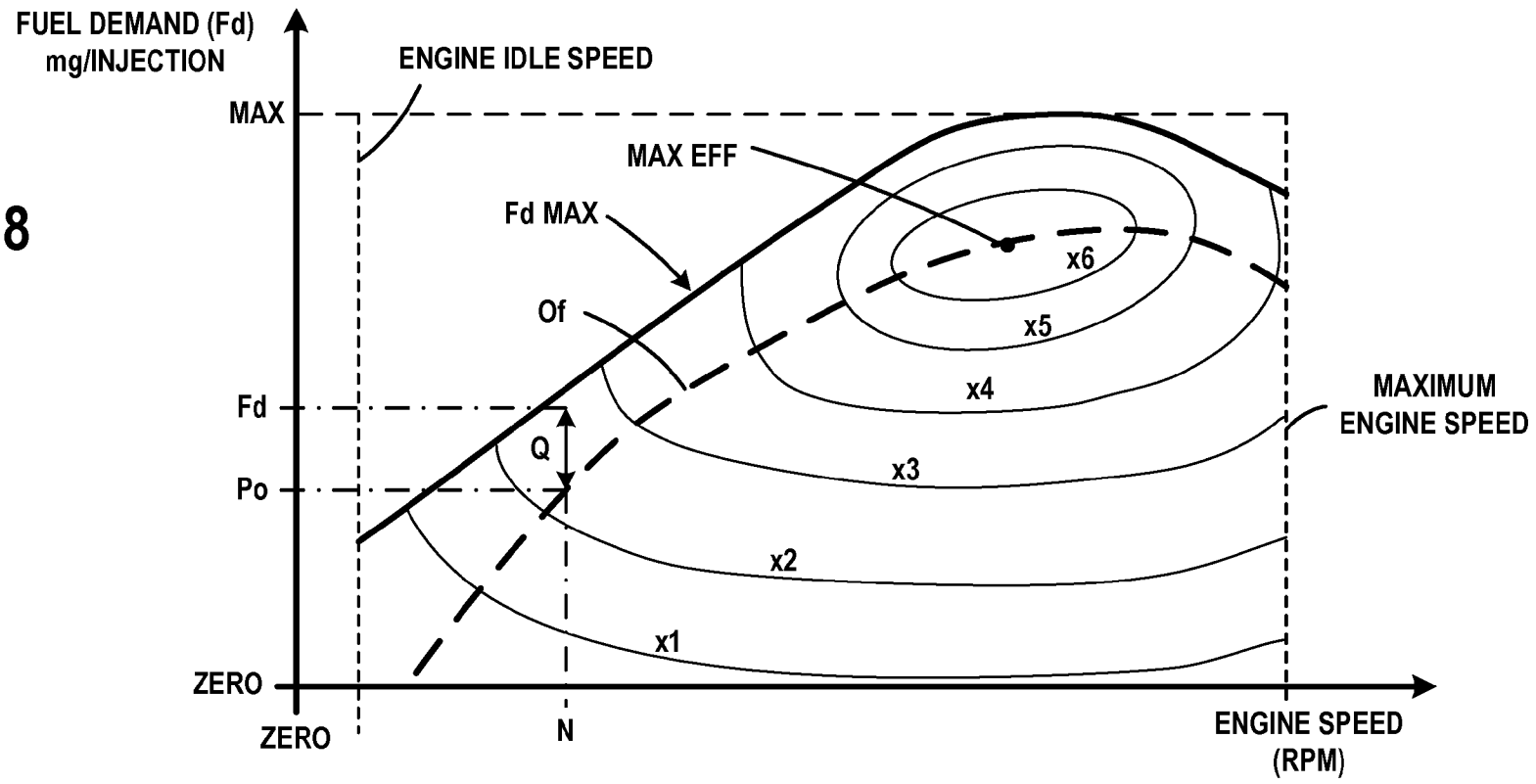
FIG. 8 is a fuel demand versus engine speed chart similar to FIG. 7 showing a situation in which a fuel demand from an engine is greater than a supply available from a fuel pump if the fuel pump is operated at optimum efficiency for that engine speed "an optimum fuel demand level" and a volume of fuel (Q) is supplied in accordance with the present disclosure from an accumulator to enable the fuel pump to be operated at optimum efficiency for that engine speed that is to say, at the optimum fuel demand level.

In FIG. 8 the lines x1 to x6 are lines joining points of equal high pressure fuel pump efficiency, the broken line 'Of' is a line joining points of optimum fuel pump efficiency throughout the operating speed range of the engine, Max Eff is an operational point where the high pressure fuel pump 130 is operating at a maximum efficiency and Fd max is a line showing the maximum possible fuel demand for the engine throughout its operating speed range.

At the point in time shown, the fuel demand from the engine 10 is Fd and the optimized fuel supply quantity (Po) is the fuel quantity available from the high pressure fuel pump if it is operated at optimum efficiency at the current engine speed termed the optimum fuel demand level of the high pressure fuel pump 130. The fuel demand Fd in this case is greater than the quantity of fuel (Po) that the high pressure fuel pump 130 can supply if operated at optimum efficiency. That is to say, Fd>Po. There is a shortfall in fuel supply quantity from the high pressure fuel pump 130 and a make-up fuel quantity (Q) is required. The make-up fuel quantity Q is the difference between the fuel demanded by the engine 10 and the available quantity of fuel if the high pressure fuel pump 130 is run at optimum efficiency for that engine speed (N). The high pressure fuel pump 130 would need to be run inefficiently to provide this make-up fuel quantity.

Figure 9:
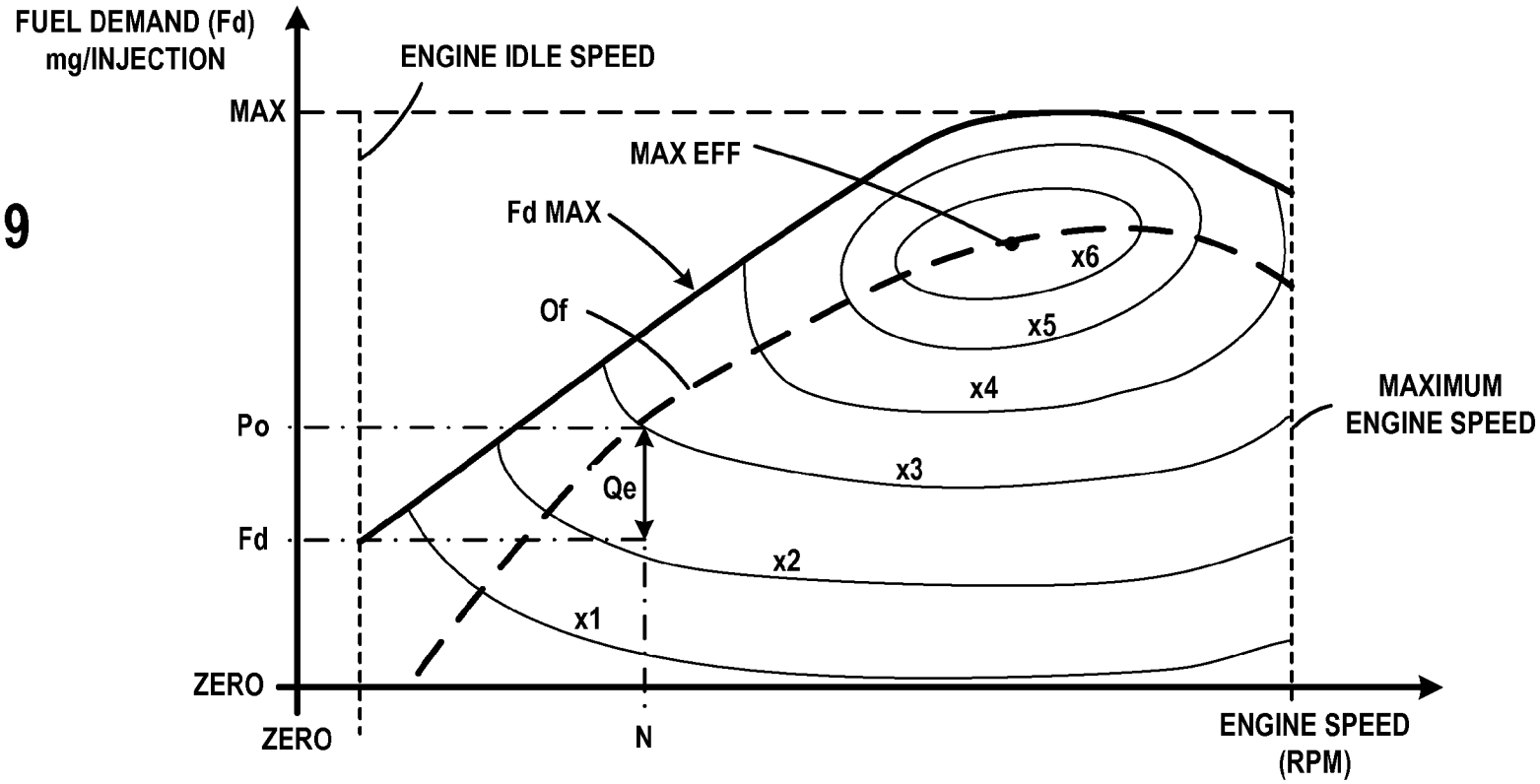
FIG. 9 is a fuel demand versus engine speed chart similar to FIG. 8 but showing a situation in which a fuel demand from an engine is less than a supply available from a fuel pump if the fuel pump is operated at optimum efficiency (the optimum fuel demand level) and a volume of fuel (Qe) that is supplied in accordance with the present disclosure to the accumulator to enable the fuel pump to be operated at optimum efficiency.

In FIG. 9 the lines x1 to x6 are lines joining points of equal high pressure fuel pump efficiency, the broken line 'Of' is a line joining points of optimum fuel pump efficiency throughout the operating speed range of the engine, Max Eff is an operational point where the high pressure fuel pump 130 is operating at maximum or peak efficiency and Fd max is a line showing the maximum possible fuel demand for the engine throughout its operating speed range.

At the point in time shown, the engine is rotating at "N" Rpm, the fuel demand from the engine 10 is Fd and the optimized fuel supply quantity (Po) is the fuel quantity available from the high pressure fuel pump if it is operated at optimum efficiency at the current engine speed (N), that is to say, at its optimum demand level. The fuel demand Fd in this case is less than the quantity of fuel (Po) that the high pressure fuel pump 130 can supply if operated at peak efficiency, that is to say, Fd<Po. There is in this case a surplus in the quantity of fuel that can be supplied by the high pressure pump 130 if operated at optimum efficiency and, as described hereinafter this excess fuel quantity (Qe) is stored in the high pressure accumulator 140. The excess fuel quantity Qe is the difference between the current fuel demand Fd of the engine and the optimized fuel quantity Po available from the high pressure fuel pump 130, if the high pressure fuel pump 130 is run at optimal efficiency for the current engine speed (N). It will be appreciated that if Po=Fd then Qe=0.

The fuel supply system is controlled by the electronic controller 160 using the logic shown in FIG. 1. The electronic controller 160 operates the fuel supply system in five primary operating states as described in more detail hereinafter based upon the amount of fuel stored in the high pressure accumulator 140 and whether the fuel demand Fd from the engine 10 is greater or less than the quantity of fuel that can be supplied from the high pressure pump 130 if operated at optimum efficiency for the current engine speed.

To achieve this control the electronic controller 160 is operable to determine the quantity of fuel that can be supplied by the high pressure fuel pump 130 when operated at its optimum demand level for the current engine speed or optimum efficiency for the current engine speed by, for example, use of a look up table stored in a memory device referencing fuel quantity and engine speed and a measurement of current engine speed, the fuel demand Fd of the engine 10 from, for example, a fuel injection control unit and the quantity of fuel in the high pressure accumulator 140 by measuring the pressure of the fuel in the high pressure accumulator 140 using the pressure sensor 180.

First Operating State

In this operating state the high pressure accumulator 140 is empty (the amount of fuel being below a predefined lower threshold measured as a lower pressure threshold) and the fuel demand Fd of the engine is less than or equal to the optimized fuel supply quantity Po available from the high pressure fuel pump 130 when operated at its optimum demand level.

In the first operating state, the electronic controller 160 is operable to run the high pressure fuel pump 130 at its optimal efficiency by setting a demand level corresponding to the optimum fuel supply quantity Po for the current engine speed and controls the diverter valve 190 to permit fuel to flow to the common fuel rail 150 from fuel pump 130 and to the high pressure accumulator 140 by rotating the valve member 192 to the position shown in FIG. 10*b*.

Fuel therefore flows to the engine 10 and any excess fuel quantity Qe flows to the high pressure accumulator 140. This process will continue until the high pressure accumulator 140 is full (the amount of fuel being above a predefined upper threshold measured as an upper pressure threshold).

When the high pressure accumulator 140 is determined to be full the electronic controller 160 is operable to change the operating state of the fuel supply system from the first operating state to the fifth operating state described hereinafter.

Second Operating State

In the second operating state, the high pressure accumulator 140 is empty (the amount of fuel being below a predefined lower threshold measured as a lower pressure threshold) and the fuel demand Fd of the engine is more than the optimized fuel supply quantity Po available from the high pressure fuel pump 130 when operated at its optimum demand level.

The electronic controller 160 is operable to run the high pressure fuel pump 130 at a demand level corresponding to that required to meet the current fuel demand Fd of the engine 10. This is the same as the case for a prior art system but there is no other option as there is no fuel available in the high pressure accumulator 140 and so the fuel demand Fd must be met solely by the high pressure fuel pump 130.

The electronic controller 160 controls the diverter valve 190 to permit fuel to flow to the common fuel rail 150 from fuel pump 130 by rotating the valve member 192 to the position shown in FIG. 10*a* and sets a demand level Fd for the high pressure fuel pump 130. Fuel therefore flows only to the engine 10 because there is no excess fuel available to fill the high pressure accumulator 140. This process will continue until the fuel demand Fd from the engine no longer exceeds the optimized fuel supply quantity Po available from the high pressure fuel pump 130. When the fuel demand Fd from the engine no longer exceeds the optimized fuel supply quantity Po available from the high pressure fuel pump 130 the electronic controller 160 is operable to change the operating state of the fuel supply system from the second operating state to the first operating state previously described.

Third Operating State

In this operating state the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is less than or equal to the optimized fuel supply quantity Po available from the high pressure fuel pump 130 when operated at its optimum demand level.

In this third operating state the electronic controller 160 is operable to run the high pressure fuel pump 130 at its optimal efficiency by setting a demand level corresponding to the optimum fuel supply quantity Po for the current engine speed and controls the diverter valve 190 to permit fuel to flow to the common fuel rail 150 from fuel pump 130 and to the high pressure accumulator 140 by rotating the valve member 192 to the position shown in FIG. 10*b*.

Fuel therefore flows to the engine 10 and the excess fuel quantity Qe flows to the high pressure accumulator 140. This process will continue, provided Fd remains less than or equal to Po, until the high pressure accumulator 140 is full (the amount of fuel being above the predefined upper threshold measured as an upper pressure threshold). When the high pressure accumulator 140 is determined to be full the electronic controller 160 is operable to change the operating state of the fuel supply system from the third operating state to the fifth operating state as described hereinafter.

Fourth Operating State

In this operating state the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is more than the optimized fuel supply quantity Po available from the high pressure fuel pump 130 when operated at its optimum demand level.

In this fourth operating state the electronic controller 160 is operable to run the high pressure fuel pump 130 at a zero output by setting a demand level corresponding to zero and controls the diverter valve 190 to permit fuel to flow to the common fuel rail 150 from the high pressure accumulator 140 by rotating the valve member 192 to the position shown in FIG. 10*c*. When the diverter valve 190 is in this position fuel flows to the common fuel rail 150 from the high pressure accumulator 140 and the high pressure fuel pump 130 is effectively off thereby preventing energy being wasted driving the high pressure fuel pump 130 in a situation where it would need to be operated inefficiently to meet the fuel demand Fd from the engine 10.

This process will continue, provided the fuel demand Fd is greater than the optimized fuel supply quantity Po available from the high pressure fuel pump 130, until the high pressure accumulator 140 is determined to be 'empty'. That is to say, until the amount of fuel remaining in the high pressure accumulator 140 is less than the predefined lower threshold.

However, if the fuel demand Fd changes so as to be less than or equal to the optimized fuel supply quantity Po available from the high pressure fuel pump 130, the electronic controller 160 is operable to run the high pressure fuel pump 130 at its optimal efficiency by setting a demand level corresponding to the optimum fuel supply quantity Po for the current engine speed and controls the diverter valve 190 to permit fuel to flow from fuel pump 130 to the common fuel rail 150 and from fuel pump 130 to the high pressure accumulator 140 by rotating the valve member 192 to the position shown in FIG. 10*b*.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is less than or equal to or more than the optimum fuel supply quantity Po available from the high pressure fuel pump 130.

Fifth Operating State

In this operating state the high pressure accumulator 140 is full (the amount of fuel being above the predefined upper threshold measured as an upper pressure threshold) and the fuel demand Fd of the engine can be either more than the optimized fuel supply quantity Po available from the high pressure fuel pump 130, less than the optimized fuel supply quantity Po available from the high pressure fuel pump 130 or equal to the optimized fuel supply quantity Po available from the high pressure fuel pump 130 when operated at its optimum demand level.

In this fifth operating state the electronic controller 160 is operable to run the high pressure fuel pump 130 at a zero output by setting a demand level corresponding to zero and controls the diverter valve 190 to permit fuel to flow to the common fuel rail 150 from the high pressure accumulator 140 by rotating the valve member 192 to the position shown in FIG. 10*c*. When the diverter valve 190 is in this position, fuel flows to the common fuel rail 150 from the high pressure accumulator 140 and the high pressure fuel pump 130 is effectively off thereby preventing energy being wasted driving the high pressure fuel pump 130.

This process will continue, provided the fuel demand Fd is greater than the optimized fuel supply quantity Po available from the high pressure fuel pump 130, until the high pressure accumulator 140 is determined to be empty. That is to say, until the amount of fuel remaining in the high pressure accumulator 140 is less than the predefined lower threshold.

However, if the fuel demand Fd changes so as to be less than or equal to the optimized fuel supply quantity Po then the electronic controller 160 is operable to run the high pressure fuel pump 130 at its optimal efficiency by setting a demand level corresponding to the optimum fuel supply quantity Po for the current engine speed and controls the diverter valve 190 to permit fuel to flow to the common fuel rail 150 from fuel pump 130 and to the high pressure accumulator 140 by rotating the valve member 192 to the position shown in FIG. 10*b*.

When the high pressure accumulator 140 is determined to be empty, that is to say the amount of fuel is less than the predefined lower threshold, the electronic controller 160 is operable to select one of the first and second operating modes depending upon whether the fuel demand Fd from the engine 10 is less than or equal to the optimum fuel supply quantity Po or more than the optimum fuel supply quantity Po.

Operation of the fuel supply system 100 shown in FIG. 4 is identical to that described with respect to FIG. 3 with the exception that two valves 190A and 190B are used to control the flow of fuel rather than a single diverter valve 190.

As before, the electronic controller 160 is operable to determine the quantity of fuel that can be supplied by the high pressure fuel pump 130 when operated at optimum efficiency, the fuel demand Fd of the engine and the quantity of fuel in the high pressure accumulator 140 by measuring the pressure of the fuel in the high pressure accumulator 140 using the pressure sensor 180.

First Operating State

As before, the high pressure accumulator 140 is empty (the amount of fuel being below a predefined lower threshold measured as a lower pressure threshold) and the fuel demand Fd of the engine is less than or equal to the optimized fuel supply quantity Po available from the high pressure fuel pump 130 when operated at its optimum demand level.

The electronic controller 160 is operable to run the high pressure fuel pump 130 at its optimal efficiency by setting a demand level corresponding to the optimum fuel supply quantity Po for the current engine speed and controls the valves 190A and 190B to permit fuel to flow to the common fuel rail 150 from fuel pump 130 and to the high pressure accumulator 140.

Fuel therefore flows to the engine 10 and the excess fuel quantity Qe flows to the high pressure accumulator 140. This process will continue until the high pressure accumulator 140 is full (the amount of fuel being above a predefined upper threshold measured as an upper pressure threshold). When the high pressure accumulator 140 is determined to be full, the electronic controller 160 is operable to change the operating state of the fuel supply system from the first operating state to the fifth operating state described hereinafter.

Second Operating State

As before, the high pressure accumulator 140 is empty (the amount of fuel being below a predefined lower threshold measured as a lower pressure threshold) and the fuel demand Fd of the engine is more than the optimized fuel supply quantity Po available from the high pressure fuel pump when operated at its optimum demand level.

In this second operating state the electronic controller 160 is operable to run the high pressure fuel pump 130 at a demand level corresponding to that required to meet the current fuel demand Fd of the engine 10. This is the same as the case for a prior art system but there is no other option as there is no fuel available in the high pressure accumulator 140 and so the fuel demand Fd must be met solely by the high pressure fuel pump 130.

The electronic controller 160 controls the valve 190A to permit fuel to flow to the common fuel rail 150 from fuel pump 130, shuts the valve 190B so as to prevent fuel flowing to the high pressure accumulator 140 and sets a demand level Fd for the high pressure fuel pump 130. Fuel therefore flows only to the engine 10 because there is no excess fuel available to fill the high pressure accumulator 140. This process will continue until the fuel demand Fd from the engine no longer exceeds the optimized fuel supply quantity Po available from the high pressure fuel pump 130. When the fuel demand Fd from the engine no longer exceeds the optimized fuel supply quantity Po available from the high pressure fuel pump 130 the electronic controller 160 is operable to change the operating state of the fuel supply system from the second operating state to the first operating state previously described.

Third Operating State

As before, the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is less than or equal to the optimized fuel supply quantity Po available from the high pressure fuel pump 130 when operated at its optimum demand level.

In this third operating state the electronic controller 160 is operable to run the high pressure fuel pump 130 at its optimal efficiency by setting a demand level corresponding to the optimum fuel supply quantity Po for the current engine speed and controls the valves 190A, 190B to permit fuel to flow to the common fuel rail 150 from fuel pump 130 and to the high pressure accumulator 140 by moving the valve 190B to a position in which fuel can flow from the high pressure fuel pump 130 to the high pressure accumulator 140 and moving the valve 190A to a position in which fuel can flow from the high pressure fuel pump 130 to the common fuel rail 150 but in which fuel is prevented from flowing from the high pressure accumulator 140 to the common fuel rail 150.

Fuel therefore flows to the engine 10 and any excess fuel quantity Qe flows to the high pressure accumulator 140. This process will continue (provided Fd remains less than or equal to Po) until the high pressure accumulator 140 is full (the amount of fuel being above the predefined upper threshold measured as an upper pressure threshold).

When the high pressure accumulator 140 is determined to be full the electronic controller 160 is operable to change the operating state of the fuel supply system from the third operating state to the fifth operating state as described hereinafter.

Fourth Operating State

As before, the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is more than the optimized fuel supply quantity Po available from the high pressure fuel pump 130 when operated at its optimum demand level.

In this fourth operating state the electronic controller 160 is operable to run the high pressure fuel pump 130 at a zero output by setting a demand level corresponding to zero and controls the valves 190A, 190B to permit fuel to flow to the common fuel rail 150 from the high pressure accumulator 140 but prevents fuel from flowing to or from the high pressure fuel pump 130.

When the valves 190A, 190B are in these positions, fuel flows to the common fuel rail 150 from the high pressure accumulator 140 and the high pressure fuel pump 130 is effectively off thereby preventing energy being wasted driving the high pressure fuel pump 130 in a situation where it would need to be operated inefficiently to meet the fuel demand Fd from the engine 10.

This process will continue, provided the fuel demand Fd is greater than the optimized fuel supply quantity Po available from the high pressure fuel pump 130, until the high pressure accumulator 140 is determined to be empty.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is less than or equal to the optimized fuel supply quantity Po or more than the optimized fuel supply quantity Po available from the high pressure fuel pump 130.

Fifth Operating State

As before, the high pressure accumulator 140 is full (the amount of fuel being above the predefined upper threshold measured as an upper pressure threshold) and the fuel demand Fd of the engine can be either more than the optimized fuel supply quantity Po available from the high pressure fuel pump 130, less than the optimized fuel supply quantity Po or equal to the optimized fuel supply quantity Po available from the high pressure fuel pump 130 when operated at its optimum demand level.

In this fifth operating state the electronic controller 160 is operable to run the high pressure fuel pump 130 at a zero output by setting a demand level corresponding to zero and controls the valves 190A, 190B to permit fuel to flow to the common fuel rail 150 from the high pressure accumulator 140 but prevents fuel flowing to or from the high pressure fuel pump 130.

When the valves 190A, 190B are in these positions, fuel flows to the common fuel rail 150 from the high pressure accumulator 140 and the high pressure fuel pump 130 is effectively off thereby preventing energy being wasted driving the high pressure fuel pump 130. This process will continue, provided the fuel demand Fd is greater than the optimized fuel supply quantity Po available from the high pressure fuel pump 130, until the high pressure accumulator 140 is determined to be empty.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is less than or more than the optimum fuel supply quantity Po.

Operation of the fuel supply system 100 shown in FIG. 5 is identical to that described with respect to FIG. 3 with the exception that two valves 190A and 190B are used to control the flow of fuel rather than a single diverter valve 190.

As before, the electronic controller 160 is operable to determine the quantity of fuel that can be supplied by the high pressure fuel pump 130 when operated at optimum efficiency, the fuel demand Fd of the engine and the quantity of fuel in the high pressure accumulator 140 by measuring the pressure of the fuel in the high pressure accumulator 140 using the pressure sensor 180.

First Operating State

As before, the high pressure accumulator 140 is empty (the amount of fuel being below a predefined lower threshold measured as a lower pressure threshold) and the fuel demand Fd of the engine is less than or equal to the optimized fuel supply quantity Po available from the high pressure fuel pump 130 when operated at its optimum demand level.

The electronic controller 160 is operable to run the high pressure fuel pump 130 at its optimal efficiency by setting a demand level corresponding to the optimum fuel supply quantity Po for the current engine speed and controls the valves 190A and 190B to permit fuel to flow to the common fuel rail 150 from fuel pump 130 and to the high pressure accumulator 140 from the high pressure fuel pump 130.

Fuel therefore flows to the engine 10 and the excess fuel quantity Qe flows to the high pressure accumulator 140. This process will continue until the high pressure accumulator 140 is full (the amount of fuel being above a predefined upper threshold measured as an upper pressure threshold). When the high pressure accumulator 140 is determined to be full the electronic controller 160 is operable to change the operating state of the fuel supply system from the first operating state to the fifth operating state.

Second Operating State

As before, the high pressure accumulator 140 is empty (the amount of fuel being below a predefined lower threshold measured as a lower pressure threshold) and the fuel demand Fd of the engine is more than the optimized fuel supply quantity Po available from the high pressure fuel pump 130 when operated at its optimum demand level.

In this second operating state the electronic controller 160 is operable to run the high pressure fuel pump 130 at a demand level corresponding to that required to meet the current fuel demand Fd of the engine 10. This is the same as the case for a prior art system but there is no other option as there is no fuel available in the high pressure accumulator 140 and so the fuel demand Fd must be met solely by the high pressure fuel pump 130.

The electronic controller 160 controls the valve 190A to permit fuel to flow to the common fuel rail 150 from the fuel pump 130 but prevents fuel from flowing to the high pressure accumulator 140, shuts the valve 190B so as to prevent fuel flowing from the high pressure accumulator 140 to the common fuel rail 150 and sets a demand level Fd for the high pressure fuel pump 130. Fuel therefore flows only to the engine 10 because there is no excess fuel available to fill the high pressure accumulator 140. This process will continue until the fuel demand Fd from the engine no longer exceeds the optimized fuel supply quantity Po available from the high pressure fuel pump 130. When the fuel demand Fd from the engine no longer exceeds the optimized fuel supply quantity Po available from the high pressure fuel pump 130 the electronic controller 160 is operable to change the operating state of the fuel supply system from the second operating state to the first operating state previously described.

Third Operating State

As before, the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is less than or equal to the optimized fuel supply quantity Po available from the high pressure fuel pump 130 when operated at its optimum demand level.

In this third operating state the electronic controller 160 is operable to run the high pressure fuel pump 130 at its optimal efficiency by setting a demand level corresponding to the optimum fuel supply quantity Po available from the high pressure fuel pump 130 for the current engine speed and controls the valves 190A, 190B to permit fuel to flow to the common fuel rail 150 from the high pressure fuel pump 130 and to flow to the high pressure accumulator 140.

This is achieved by moving the valve 190A to a position in which fuel can flow from the high pressure fuel pump 130 to the high pressure accumulator 140 and the common fuel rail 150 and moving the valve 190B to a position in which no fuel can flow from the high pressure accumulator 140 to the common fuel rail 150.

Fuel therefore flows to the engine 10 and any excess fuel quantity Qe flows to the high pressure accumulator 140. This process will continue (provided Fd remains less than or equal to Po) until the high pressure accumulator 140 is full (the amount of fuel being above the predefined upper threshold measured as an upper pressure threshold). When the high pressure accumulator 140 is determined to be full, the electronic controller 160 is operable to change the operating state of the fuel supply system from the third operating state to the fifth operating state.

Fourth Operating State

As before, the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is more than the optimized fuel supply quantity Po available from the high pressure fuel pump when operated at its optimum demand level.

In this fourth operating state the electronic controller 160 is operable to run the high pressure fuel pump 130 at a zero output by setting a demand level corresponding to zero and controls the valves 190A, 190B to permit fuel to flow to the common fuel rail 150 from the high pressure accumulator 140 but prevents fuel from flowing to or from the high pressure fuel pump 130.

When the valves 190A, 190B are in these positions, fuel flows to the common fuel rail 150 from the high pressure accumulator 140 and the high pressure fuel pump 130 is effectively off thereby preventing energy being wasted driving the high pressure fuel pump 130 in a situation where it would need to be operated inefficiently to meet the fuel demand Fd from the engine 10.

This process will continue, provided the fuel demand Fd is greater than the optimized fuel supply quantity Po available from the high pressure fuel pump 130, until the high pressure accumulator 140 is determined to be empty.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is less than or more than the optimum fuel supply quantity PO.

Fifth Operating State

As before, the high pressure accumulator 140 is full (the amount of fuel being above the predefined upper threshold measured as an upper pressure threshold) and the fuel demand Fd of the engine can be either more than the optimized fuel supply quantity Po available from the high pressure fuel pump 130, less than the optimized fuel supply quantity Po available from the high pressure fuel pump 130 or equal to the optimized fuel supply quantity Po available from the high pressure fuel pump 130 when operated at its optimum demand level.

In this fifth operating state the electronic controller 160 is operable to run the high pressure fuel pump 130 at a zero output by setting a demand level corresponding to zero and controls the valves 190A, 190B to permit fuel to flow to the common fuel rail 150 from the high pressure accumulator 140 but prevents fuel flowing to or from the high pressure fuel pump 130. When the valves 190A, 190B are in these positions, fuel flows to the common fuel rail 150 from the high pressure accumulator 140 and the high pressure fuel pump 130 is effectively off thereby preventing energy being wasted driving the high pressure fuel pump 130.

This process will continue, provided the fuel demand Fd is greater than the optimized fuel supply quantity Po available from the high pressure fuel pump 130, until the high pressure accumulator 140 is determined to be empty.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is more than the optimized fuel supply quantity Po available from the high pressure fuel pump 130.

Operation of the fuel supply system 100 shown in FIG. 6 is identical to that described with respect to FIG. 3 with the exception that a single valve 290 is interposed between the high pressure accumulator 140 and the common fuel rail 150 rather than a diverter valve 190 interposed between the high pressure fuel pump 130 and both the common fuel rail 150 and the high pressure accumulator 140.

As before, the electronic controller 160 is operable to determine the quantity of fuel that can be supplied by the high pressure fuel pump 130 when operated at optimum efficiency, the fuel demand Fd of the engine and the quantity of fuel in the high pressure accumulator 140 by measuring the pressure of the fuel in the high pressure accumulator 140 using the pressure sensor 180.

First Operating State

As before, the high pressure accumulator 140 is empty (the amount of fuel being below a predefined lower threshold measured as a lower pressure threshold) and the fuel demand Fd of the engine is less than or equal to the optimized fuel supply quantity Po available from the high pressure fuel pump 130 when operated at its optimum demand level.

The electronic controller 160 is operable to run the high pressure fuel pump 130 at its optimal efficiency by setting a demand level corresponding to the optimum fuel supply quantity Po for the current engine speed and controls the valve 290 to permit fuel to flow to the common fuel rail 150 from fuel pump 130 and to the high pressure accumulator 140 from the high pressure fuel pump 130 via the common fuel rail 150.

Fuel therefore flows to the engine 10 and the excess fuel quantity Qe flows via the common fuel rail 150 to the high pressure accumulator 140. This process will continue until the high pressure accumulator 140 is full (the amount of fuel being above a predefined upper threshold measured as an upper pressure threshold).

When the high pressure accumulator 140 is determined to be full, the electronic controller 160 is operable to change the operating state of the fuel supply system from the first operating state to the fifth operating state.

Second Operating State

As before, the high pressure accumulator 140 is empty (the amount of fuel being below a predefined lower threshold measured as a lower pressure threshold) and the fuel demand Fd of the engine is more than the optimized fuel supply quantity Po available from the high pressure fuel pump 130 when operated at its optimum demand level.

In this second operating state the electronic controller 160 is operable to run the high pressure fuel pump 130 at a demand level corresponding to that required to meet the current fuel demand Fd of the engine 10. This is the same as the case for a prior art system but there is no other option as there is no fuel available in the high pressure accumulator 140 and so the fuel demand Fd must be met solely by the high pressure fuel pump 130.

The electronic controller 160 controls the valve 290 to prevent fuel from flowing to or from the high pressure accumulator 140 and sets a demand level Fd for the high pressure fuel pump 130. Fuel therefore flows only to the engine 10 because there is no excess fuel available to fill the high pressure accumulator 140. This process will continue until the fuel demand Fd from the engine no longer exceeds the optimized fuel supply quantity Po available from the high pressure fuel pump 130. When the fuel demand Fd from the engine no longer exceeds the optimized fuel supply quantity Po available from the high pressure fuel pump 130 the electronic controller 160 is operable to change the operating state of the fuel supply system from the second operating state to the first operating state previously described.

Third Operating State

As before, the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is less than or equal to the optimized fuel supply quantity Po available from the high pressure fuel pump 130 when operated at its optimum demand level.

In this third operating state the electronic controller 160 is operable to run the high pressure fuel pump 130 at its optimal efficiency by setting a demand level corresponding to the optimum fuel supply quantity Po for the current engine speed and controls the valve 290 to permit fuel to flow via the common fuel rail 150 to the high pressure accumulator 140.

Fuel therefore flows to the engine 10 and the excess fuel quantity Qe flows to the high pressure accumulator 140. This process will continue (provided Fd remains less than or equal to Po) until the high pressure accumulator 140 is full (the amount of fuel being above the predefined upper threshold measured as an upper pressure threshold). When the high pressure accumulator 140 is determined to be full, the electronic controller 160 is operable to change the operating state of the fuel supply system from the third operating state to the fifth operating state as described hereinafter.

Fourth Operating State

As before, the high pressure accumulator 140 is not empty (the amount of fuel being above a predefined lower threshold measured as a lower pressure threshold) but is not full (the amount of fuel being below the predefined upper threshold measured as an upper pressure threshold) and the fuel demand Fd of the engine is more than the optimised fuel supply quantity Po available from the high pressure fuel pump 130 when operated at its optimum demand level.

In this fourth operating state the electronic controller 160 is operable to run the high pressure fuel pump 130 at a zero output by setting a demand level corresponding to zero and controls the valve 290 to permit fuel to flow to the common fuel rail 150 from the high pressure accumulator 140. Fuel is prevented from flowing to the high pressure fuel pump 130 by means of a one way valve (not shown) but indicated by the direction of the arrow joining the high pressure fuel pump 130 to the common fuel rail 150 on FIG. 6.

When the valve 290 is in this position, fuel flows to the common fuel rail 150 from the high pressure accumulator 140. The high pressure fuel pump 130 is effectively off thereby preventing energy being wasted driving the high pressure fuel pump 130 in a situation where it would need to be operated inefficiently to meet the fuel demand Fd from the engine 10.

This process will continue, provided the fuel demand Fd is greater than the optimised fuel supply quantity Po available from the high pressure fuel pump 130, until the high pressure accumulator 140 is determined to be empty.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is more than the optimum fuel supply quantity Po available from the high pressure fuel pump 130.

Fifth Operating State

As before, the high pressure accumulator 140 is full (the amount of fuel being above the predefined upper threshold measured as an upper pressure threshold) and the fuel demand Fd of the engine can be more than, less than or equal to the optimised fuel supply quantity Po available from the high pressure fuel pump 130 when operated at its optimum demand level.

In this fifth operating state the electronic controller 160 is operable to run the high pressure fuel pump 130 at a zero output by setting a demand level corresponding to zero and controls the valve 290 to permit fuel to flow to the common fuel rail 150 from the high pressure accumulator 140. Fuel is prevented from flowing to the high pressure fuel pump 130 by a one way valve (not shown) indicated by the direction of the arrow on FIG. 6 joining the high pressure fuel pump 130 to the common fuel rail 150.

When the valve 290 is in this position, fuel flows to the common fuel rail 150 from the high pressure accumulator 140. The high pressure fuel pump 130 is effectively off thereby preventing energy being wasted driving the high pressure fuel pump 130.

This process will continue, provided the fuel demand Fd is greater than the optimised fuel supply quantity Po available from the high pressure fuel pump 130, until the high pressure accumulator 140 is determined to be empty.

When the high pressure accumulator 140 is determined to be empty, that is to say, the amount of fuel is less than the predefined lower threshold, the electronic controller 160 is operable to select one of the first and second operating modes depending upon whether the fuel demand Fd from the engine 10 is more than the optimum fuel supply quantity Po.

It will be appreciated that the term 'empty' in relation to the high pressure accumulator 140 means below a predefined lower threshold amount of fuel and that the term 'full' in relation to the high pressure accumulator 140 means above a predefined upper threshold amount of fuel. As previously discussed, these predefined lower and upper thresholds may be set in the form of lower and upper fuel pressure thresholds for the high pressure accumulator 140. Whether the pressure is above or below either of these thresholds can be determined by measuring the pressure within the high pressure accumulator 140 using the associated pressure sensor 180.

Therefore in summary, the present disclosure provides a method and fuel supply system that uses a high pressure accumulator to compensate for variation in engine fuel demand so as to permit a high pressure fuel pump to be operated at or very close to its optimum output at all times thereby reducing the fuel required by the engine to drive the high pressure fuel pump.

Advantageously, when fuel beyond a predefined amount is available in the high pressure accumulator, the fuel from the accumulator is used whenever the fuel demand from the engine is more than the optimised quantity of fuel that can be provided by the high pressure fuel pump requiring the high pressure fuel pump to be operated at a level above its optimum demand level and in some cases when the fuel demand from the engine is equal to the optimised quantity of fuel that can be provided by the high pressure fuel pump when operated at its optimum demand level.

It will be appreciated by those skilled in the art that although the present disclosure has been described by way of example with reference to one or more embodiments it is not limited to the disclosed embodiments and that alternative embodiments could be constructed without departing from the scope of the present disclosure as defined by the appended claims.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

operating an engine driven fuel pump at one of a zero demand level and an optimum demand level while using a valve to control a fuel flow from the fuel pump and an accumulator to meet an engine fuel demand; and operating the fuel pump above its optimal level when the accumulator is empty and the fuel demand is greater than fuel available from the optimally operated fuel pump, including operating the fuel pump inefficiently compared to the optimal level to provide fuel to only an engine while preventing flow to the accumulator.

2. The method of claim 1, further comprising determining a current fuel level in the accumulator, the fuel demand from the engine, and a current fuel quantity available from the fuel pump when operating at the optimum demand level while controlling the fuel flow to the engine from the fuel pump and the accumulator to meet the fuel demand from the engine.

3. The method of claim 1, wherein, if an amount of fuel in the accumulator is below a predefined threshold and the fuel demand from the engine is less than a current fuel quantity available from the fuel pump when operating at the optimum demand level, the fuel pump is operated at the optimum demand level and any excess fuel is supplied from the fuel pump to the accumulator.

4. The method of claim 1, wherein, if an amount of fuel in the accumulator is above a predefined threshold, the fuel pump is operated at the zero demand level and fuel is supplied to the engine from the accumulator to meet the fuel demand from the engine.

5. The method of claim 1, wherein, if an amount of fuel in the accumulator is between a predefined lower threshold and a predefined upper threshold and the fuel demand from the engine is more than a current fuel quantity available from the fuel pump when operating at the optimum demand level, the fuel pump is operated at the zero demand level and fuel is supplied to the engine from the accumulator to meet the fuel demand from the engine.

6. The method of claim 1, wherein, if an amount of fuel in the accumulator is between a predefined lower threshold and a predefined upper threshold and the fuel demand from the engine is one of more than and equal to a current fuel quantity available from the fuel pump when operating at the optimum demand level, the fuel pump is operated at the zero demand level and fuel is supplied to the engine from the accumulator to meet the fuel demand from the engine.

7. The method of claim 1, wherein, if an amount of fuel in the accumulator is above a predefined threshold and the fuel demand from the engine is more than a current fuel demand from the fuel pump when operating at the optimum demand level, the fuel pump is operated at the optimum demand level and fuel is supplied to the engine from the accumulator to meet the fuel demand from the engine.

8. An engine fuel supply system comprising:

a fuel reservoir;

a low pressure fuel pump to supply fuel from the reservoir to an engine driven high pressure fuel pump;

at least one fuel injector to supply fuel at high pressure to an engine;

a fuel accumulator to store fuel at high pressure;

a valve means to control a flow of fuel between the high pressure fuel pump, the accumulator, and the engine; and an electronic controller to control an operation of the high pressure fuel pump, the valve means, and the at least one fuel injector, wherein the electronic controller operates the high pressure fuel pump at one of a zero demand level and an optimum demand level and uses the valve means to control the flow of fuel to the engine from the high pressure fuel pump and the accumulator to meet a fuel demand from the engine unless the accumulator is empty and the fuel demand from the engine is greater than an amount of fuel available from the high pressure fuel pump when operated at the optimum demand level, including operating the high pressure fuel pump inefficiently compared to the optimum demand level to provide fuel to only the engine while preventing flow to the accumulator.

9. The system of claim 8, wherein the electronic controller is further operable to estimate a current fuel level in the accumulator, estimate the fuel demand from the engine, and estimate a current fuel quantity available from the high pressure fuel pump when operating at the optimum demand level while controlling the flow of fuel to the engine from the high pressure fuel pump and the accumulator to meet the fuel demand from the engine based upon at least one of the amount of fuel stored in the accumulator and a comparison of the current fuel quantity available from the high pressure fuel pump when operating at the optimum demand level with the fuel demand from the engine.

10. The system of claim 8, wherein, if the amount of fuel in the accumulator is below a predefined threshold and the fuel demand from the engine is less than a current fuel quantity available from the high pressure fuel pump when operating at the optimum demand level, the electronic controller operates the high pressure fuel pump at the optimum demand level while controlling the valve means so that any excess fuel is supplied from the high pressure fuel pump to the accumulator.

11. The system of claim 8, wherein, if the amount of fuel in the accumulator is above a predefined threshold, the electronic controller operates the high pressure fuel pump at the zero demand level and operates the valve means to permit fuel to be supplied to the engine from the accumulator to meet the fuel demand from the engine.

12. The system of claim 8, wherein, if the amount of fuel in the accumulator is between a predefined lower threshold and a predefined upper threshold and the fuel demand from the engine is more than a current fuel quantity available from the high pressure fuel pump when operating at the optimum demand level, the electronic controller operates the high pressure fuel pump at the zero demand level and operates the valve means to supply fuel from the accumulator to the engine to meet the fuel demand from the engine.

13. The system of claim 8, wherein, if the amount of fuel in the accumulator is between a predefined lower threshold and a predefined upper threshold and the fuel demand from the engine is one of more than and equal to a current fuel quantity available from the high pressure fuel pump when operating at the optimum demand level, the electronic controller operates the high pressure fuel pump at the zero demand level and operates the valve means so that fuel is supplied to the engine from the accumulator to meet the fuel demand from the engine.

14. The system of claim 8, wherein the accumulator is a bellows type of accumulator that comprises a body having a flow passage to allow fuel to enter or leave a storage volume, the storage volume being defined by a cup shaped piston, a metal bellows, and the body, wherein the piston supports the metal bellows and is slidingly supported by the body, and wherein the metal bellows is configured to be sealed to both the body and the piston so no fuel can leak from the accumulator.

15. A motor vehicle having an engine and a fuel supply system, comprising:

a fuel reservoir;

a low pressure fuel pump to supply fuel from the fuel reservoir to an engine driven high pressure fuel pump;

at least one fuel injector to supply fuel at high pressure to the engine;

a fuel accumulator to store fuel at high pressure;

a valve means to control a flow of fuel between the engine driven high pressure fuel pump, the fuel accumulator, and the engine; and an electronic controller to control an operation of the engine driven high pressure fuel pump, the valve means, and the at least one fuel injector, wherein the electronic controller operates the engine driven high pressure fuel pump at one of a zero demand level and an optimum demand level and uses the valve means to control the flow of fuel to the engine from the engine driven high pressure fuel pump and the fuel accumulator to meet a fuel demand from the engine unless the fuel accumulator is empty and the fuel demand from the engine is greater than an amount of fuel available from the engine driven high pressure fuel pump when operated at the optimum demand level, including operating the engine driven high pressure fuel pump inefficiently compared to the optimum demand level to provide fuel to only the engine while preventing flow to the fuel accumulator.

16. The motor vehicle of claim 15, wherein the electronic controller is further operable to estimate a current fuel level in the fuel accumulator, estimate the fuel demand from the engine, and estimate a current fuel quantity available from the engine driven high pressure fuel pump when operating at the optimum demand level while controlling the flow of fuel to the engine from the engine driven high pressure fuel pump and the fuel accumulator to meet the fuel demand from the engine based upon at least one of the amount of fuel stored in the fuel accumulator and a comparison of the current fuel quantity available from the engine driven high pressure fuel pump when operating at the optimum demand level with the fuel demand from the engine.

17. The motor vehicle of claim 15, wherein, if the amount of fuel in the fuel accumulator is below a predefined threshold and the fuel demand from the engine is less than a current fuel quantity available from the engine driven high pressure fuel pump when operating at the optimum demand level, the electronic controller operates the engine driven high pressure fuel pump at the optimum demand level while controlling the valve means so that any excess fuel is supplied from the engine driven high pressure fuel pump to the fuel accumulator.

18. The motor vehicle of claim 15, wherein, if the amount of fuel in the fuel accumulator is above a predefined threshold, the electronic controller operates the engine driven high pressure fuel pump at the zero demand level and operates the valve means to permit fuel to be supplied to the engine from the fuel accumulator to meet the fuel demand from the engine.

19. The motor vehicle of claim 15, wherein, if the amount of fuel in the fuel accumulator is between a predefined lower threshold and a predefined upper threshold and the fuel demand from the engine is more than a current fuel quantity available from the engine driven high pressure fuel pump when operating at the optimum demand level, the electronic controller operates the engine driven high pressure fuel pump at the zero demand level and operates the valve means to supply fuel from the fuel accumulator to the engine to meet the fuel demand from the engine.

20. The motor vehicle of claim 15, wherein, if the amount of fuel in the fuel accumulator is between a predefined lower threshold and a predefined upper threshold and the fuel demand from the engine is one of more than and equal to a current fuel quantity available from the engine driven high pressure fuel pump when operating at the optimum demand level, the electronic controller operates the engine driven high pressure fuel pump at the zero demand level and operates the valve means so that fuel is supplied to the engine from the fuel accumulator to meet the fuel demand from the engine.

* * * * *